US011466958B2

(12) United States Patent
Bernal

(10) Patent No.: US 11,466,958 B2
(45) **Date of Patent: *Oct. 11, 2022**

(54) TOY LAUNCH APPARATUS WITH MULTIPLE IMPROVISED PROJECTILE CHECKING AND LOCKING METHODS

(71) Applicant: Hasbro, Inc., Pawtucket, RI (US)

(72) Inventor: Dennis Bernal, Milford, MA (US)

(73) Assignee: Hasbro, Inc., Pawtucket, RI (US)

( * ) Notice: Subject to any disclaimer, the term of this patent is extended or adjusted under 35 U.S.C. 154(b) by 71 days.

This patent is subject to a terminal disclaimer.

(21) Appl. No.: 17/161,005

(22) Filed: Jan. 28, 2021

(65) Prior Publication Data

US 2021/0172701 A1 Jun. 10, 2021

Related U.S. Application Data

(62) Division of application No. 16/827,993, filed on Mar. 24, 2020, now Pat. No. 10,907,929.

(60) Provisional application No. 62/901,777, filed on Sep. 17, 2019, provisional application No. 62/824,000, filed on Mar. 26, 2019.

(51) Int. Cl.

| | |
|---|---|
| ***F41B 11/00*** | (2013.01) |
| ***F41B 11/723*** | (2013.01) |
| ***F41B 11/64*** | (2013.01) |
| ***F41B 11/89*** | (2013.01) |
| *F41B 11/54* | (2013.01) |

(52) U.S. Cl.

CPC ..... *F41B 11/723* (2013.01); *F41B 11/64* (2013.01); *F41B 11/89* (2013.01); *F41B 11/54* (2013.01)

(58) Field of Classification Search

CPC ..... F41B 11/723; F41B 11/64; F41B 11/89; F41B 11/54; F41B 11/642; F41B 7/08; F41B 7/003

USPC ..... 124/66, 73, 78, 56

See application file for complete search history.

(56) References Cited

U.S. PATENT DOCUMENTS

| | | | |
|---|---|---|---|
| 1,441,975 | A | 1/1923 | Edelin |
| 1,488,995 | A | 4/1924 | McCollom |
| 2,737,942 | A | 3/1956 | Horowitz et al. |
| 3,054,536 | A | 9/1962 | Sagarin |
| 3,420,133 | A | 1/1969 | Proll |
| 3,990,426 | A | 11/1976 | Stokes |

(Continued)

OTHER PUBLICATIONS

PCT/US20/24401 ISR Transmittal, Written Opinion, and ISA Search 1-743 PCT papers dated Jul. 27, 2020.

(Continued)

*Primary Examiner* — Michael D David

(74) *Attorney, Agent, or Firm* — Perry Hoffman

(57) ABSTRACT

An improvised projectile checking housing assembly having latch button and first and second sidewalls with first and second catch apertures opening as a catch latch recess of elongated structure using an improvised projectile checking spring opening to receive a locking key structure based upon the projectile receiving opening to the improvised projectile checking housing assembly. Alternate rearward translating lock gauge at the backside of a dart drum uses a follower and engaging cam surfaces locking and unlocking a pathway for correct dart alignment. Alternate motorized, non-motorized and pneumatic structures are disclosed with apparatus launch operations moving between checking and non-checking positions.

20 Claims, 36 Drawing Sheets

(56) References Cited

U.S. PATENT DOCUMENTS

| | | | |
|---|---|---|---|
| 4,170,215 | A | 10/1979 | Kettlestrings |
| 4,212,285 | A | 7/1980 | Cagan et al. |
| 4,248,202 | A | 2/1981 | Jaworski et al. |
| 4,659,320 | A | 4/1987 | Rich et al. |
| 4,841,945 | A | 6/1989 | Braden |
| 4,890,404 | A | 1/1990 | Ferri |
| 5,156,137 | A | 10/1992 | Clayton |
| 5,165,383 | A | 11/1992 | Ebert et al. |
| 5,186,156 | A | 2/1993 | Clayton |
| 5,205,271 | A | 4/1993 | Casas-Salva |
| 5,471,967 | A | 12/1995 | Matsuzaki et al. |
| 5,529,050 | A | 6/1996 | D'Andrade |
| 5,575,270 | A | 11/1996 | Casas-Salva |
| 6,488,019 | B2 | 12/2002 | Kotsiopoulos |
| 7,051,727 | B2 | 5/2006 | Wu |
| 8,082,909 | B2 | 12/2011 | Sopinsky et al. |
| 8,127,753 | B1 | 3/2012 | Brooks et al. |
| 8,397,705 | B2 | 3/2013 | DeHaan et al. |
| 8,567,378 | B2 | 10/2013 | Nugent |
| 8,695,579 | B2 | 4/2014 | Huebl |
| 8,875,688 | B2 | 11/2014 | Nugent |
| 8,967,130 | B2 | 3/2015 | Victor et al. |
| 9,027,541 | B2 | 5/2015 | Huebl |
| 9,097,484 | B2 | 8/2015 | Poirier |
| 9,194,646 | B2 | 11/2015 | Victor et al. |
| 9,389,042 | B1 | 7/2016 | Clayton |
| 9,500,432 | B2 | 11/2016 | Chia |
| 9,958,230 | B1 | 5/2018 | Nugent et al. |
| D858,655 | S * | 9/2019 | Bernal ..... D21/387 |
| D896,317 | S * | 9/2020 | Bernal ..... D21/387 |
| 2002/0166551 | A1 | 11/2002 | Lee |
| 2009/0050127 | A1 | 2/2009 | Wygant |
| 2009/0095272 | A1 | 4/2009 | Zimmerman |
| 2010/0206281 | A1 | 8/2010 | Kanitz et al. |
| 2013/0112184 | A1 | 5/2013 | Corsiglia et al. |
| 2013/0239938 | A1 | 9/2013 | Nugent |
| 2013/0312722 | A1 | 11/2013 | Price |
| 2014/0352677 | A1 | 12/2014 | Chia |
| 2015/0308782 | A1 | 10/2015 | Chia |
| 2018/0051966 | A1 | 2/2018 | Isenmann |

OTHER PUBLICATIONS

PCT/US20/24422 ISR Transmittal, ISA Search 1-743 PCT papers dated Jul. 27, 2020.

EP 20165549.5 Communication of European Search Report with Written Opinion, Search papers dated Aug. 25, 2020.

EP 20165546.1 Communication of European Search Report with Written Opinion, Search papers dated Aug. 21, 2020.

* cited by examiner

Time Step 0

Time Step 1

Time Step 1

Time Step 2

Time Step 2

Time Step 3

Locked

Time Step 0

Time Step 1

Time Step 2

Pre-Time Step 0′

Time Step 1

Time Step 2

Time Step 2

Time Step A

TOY LAUNCH APPARATUS WITH MULTIPLE IMPROVISED PROJECTILE CHECKING AND LOCKING METHODS

PRIORITY CROSS-REFERENCE TO RELATED APPLICATIONS

This application is a divisional of U.S. patent application Ser. No. 16/827,993 filed on Mar. 24, 2020, and claims priority pursuant to 35 U.S.C. 119(e) from U.S. Provisional Patent Application Nos. 62/824,000 filed on Mar. 26, 2019, and 62/901,777 filed on Sep. 17, 2019.

1. FIELD OF THE INVENTION

The present invention relates generally to a toy launch apparatus, and, more particularly, to a toy projectile apparatus that has multiple improvised projectile (IP) detection features to prevent the insertion or loading of inappropriate objects and to prevent operation of the launch apparatus unless a projectile is inserted at the improvised projectile checking housing assembly of predetermined shape for correspondingly structured and appropriately sized projectiles having a corresponding feature present at a projectile receiving opening of the improvised projectile checking housing assembly and preventing another projectile from the projectile receiving opening.

2. BACKGROUND OF THE ART

Toys and other devices that discharge objects have been designed in the past with various housing and internal elements. These devices are designed to discharge specifically design projectiles to eliminate or greatly reduce bodily injury and property damage. To insure that users not succeed in inserting objects that are dangerous and/or destructive better safety features are needed.

Various launching devices are known and are disclosed in several existing patents to prevent inappropriate object use and for safety features disabling such launching apparatus from operation where an improvised projectile may have been inserted therein. U.S. Pat. No. 4,212,285 to Cagan, et al. for "Dart gun and dart therefor" issued Jul. 15, 1980 discloses a one-piece dart shaft complementary to the dart barrel with a uniform non-circular cross section so that the propelling element makes a substantially air tight seal with the dart barrel, with a barrier for positively preventing physical contact between an air displacing piston and the dart. The piston provided with a central conical element facing the dart barrel where the rearward end of such an object will be engaged by the central conical element on the piston and deflected laterally, thereby wedging such an object within the dart gun so that it cannot be mechanically propelled by physical contact with the piston.

U.S. Pat. No. 5,156,137 to Clayton for "Projectile launcher" issued Oct. 20, 1992 concerns a projectile launching device where a spring, housed inside the barrel, rests against the release member of the lever assembly such that when a projectile is inserted into the barrel it compresses the spring against the release member and pivots the lever assembly to force the hook into the barrel and into engagement with the projectile tab as being locked together. U.S. Pat. No. 5,186,156 to Clayton for "Air operated toy gun" issued Feb. 16, 1993 discloses a movable air nozzle for successive engagement with a plurality of projectile launching barrels having rearward ends reduced diameter sections facilitate generally snug airtight fit to prevent the projectile shaft rearward end from exiting the rearward opening of the barrel, without a projectile receiving opening for allowing an appropriate size projectile at an opening for checking and preventing another projectile from the projectile receiving opening.

U.S. Pat. No. 5,165,383 to Ebert, et al. for "Gun with Pivoting Barrel, Projectile Loader, and Trigger Interlock," issued Nov. 24, 1992 purports to disclose as a safety feature a BB gun with a barrel that pivots from the front. When latched the barrel is aligned and may be fired, when unlatched the barrel pivots and cannot be fired. U.S. Pat. No. 5,205,271 to Casas-Salva for "Air Rifles of the Hinged Barrel Type," issued Apr. 27, 1993 purports to disclose an air rifle with a pivoting barrel for cocking a piston/spring and a spring biased catch for holding the barrel in alignment for firing. U.S. Pat. No. 5,529,050 to D'Andrade for "Safety Nozzle For Projectile Shooting Air Gun" issued Jun. 25, 1996 purports to disclose a safety mechanism having a nozzle, a spring biased valve element, and a hollow launch tube where the valve element is located in the path of airflow from an inlet to a hollow chamber inside the launch tube, where the projectile predetermined shape pushes against plural peripheral posts rearward which opens the air passageway around a cross-shaped valve element, thus problematic in that the nozzle and the valve element is that the air pressure generated by a launch spring must bear against and flow around the valve element before reaching the projectile to cause discharge. This airflow route causes a pressure drop, a loss of energy that is not desirable or efficient. U.S. Pat. No. 5,575,270 to Casas-Salva for "Air Guns," issued Nov. 19, 1996 purports to disclose another air gun having a pivoting barrel, two spaced apart arms on the stock, and a tongue on the barrel so that when the barrel is brought into alignment the tongue fits between the arms to ensure proper location.

U.S. Pat. No. 9,097,484 to Poirier for "Toy launch apparatus with safety latches" issued Aug. 4, 2015 provides improvements for predetermined projectiles with apparatus includes multiple safety features to prevent inappropriate objects inserted into the apparatus from enabling the apparatus to operate. Therein latches are mounted which lock a shuttle to a housing assembly with the shuttle out of engagement with an abutment surface unless a properly sized projectile is inserted. U.S. Pat. No. 9,500,432 to Chia for "Hinged arm safety mechanism for foam dart launcher" issued Nov. 22, 2016 discloses a launching section with a safety arm and movable trigger, such that a non-standard dart having a length less than a minimum threshold may not engage the safety arm such that the body of safety arm may inhibit launching.

These patents and devices are of some interest, however, the prior art neither discloses toy launcher apparatus and method with enhanced play value and locking features in checking for improvised projectile, nor projectile barrel assembly structure having a projectile receiving opening at the improvised projectile checking housing assembly for correspondingly structured and appropriately sized projectiles with a corresponding feature present at the projectile receiving opening of the improvised projectile checking housing assembly and preventing another projectile from the projectile receiving opening.

SUMMARY OF THE INVENTION

In accordance with the present invention, an advantageous method and apparatus are provided in the form of a toy launch apparatus that is designed to discharge a projectile. The launcher includes several safety features to prevent unacceptable objects from being inserted into the launcher. The toy projectile apparatus has multiple improvised projectile features to prevent operation of the launch apparatus using an improvised projectile checking housing assembly for correspondingly structured and appropriately sized projectiles with a corresponding feature present at a projectile receiving opening of the improvised projectile checking housing assembly while preventing another projectile from the projectile receiving opening, with a step structure for allowing the appropriate size projectile with a corresponding step present at the projectile receiving opening.

In a further embodiment, extending rearward of the projectile retaining element, the improvised projectile checking housing assembly has an improvised projectile button and first and second sidewalls with first and second catch latch apertures opening to a catch latch recess of elongated structure using an improvised projectile checking spring opening to receive a locking key structure based upon the projectile receiving opening to the improvised projectile checking housing assembly, intermediate the proximal and distal ends of the elongated structure, and opposing the first and second catch latch apertures of the first and second sidewalls for preventing further movement of the improvised projectile checking housing unless the appropriate size projectile is present at the projectile receiving opening of the improvised projectile checking housing assembly. The improvised projectile button is mounted with the end of the elongated structure. The improvised projectile button of the elongated structure is movable between checking and non-checking positions and preventing movement thereof unless the appropriate size projectile is present at the projectile receiving opening of the improvised projectile checking housing assembly.

Briefly summarized, the invention relates to a toy launch apparatus and methods for multiple improvised projectile checking and locking features, and method for making a toy launch apparatus with a projectile retaining element to the toy launch apparatus. A projectile barrel assembly extends rearward the projectile retaining element with an improvised projectile checking housing assembly of the projectile barrel assembly movable between checking and non-checking positions. A step structure at the projectile barrel assembly has a projectile receiving opening at the improvised projectile checking housing assembly thereof for allowing an appropriate size projectile with a corresponding step present at the projectile receiving opening of the improvised projectile checking housing assembly and preventing another projectile from the projectile receiving opening. The improvised projectile button with the end of the elongated structure proximal the projectile receiving opening of the improvised projectile checking housing assembly checks the step structure, the improvised projectile button of the elongated structure movable between checking and non-checking positions. The locking key structure may be positioned rearward from the projectile receiving opening to the improvised projectile checking housing assembly, and intermediate the proximal and distal ends of the elongated structure, the opposing first and second catch latch apertures of the first and second sidewalls open to receive the locking key for preventing further movement of the improvised projectile checking housing unless the appropriate size projectile is present at the projectile receiving opening of the improvised projectile checking housing assembly.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE EMBODIMENTS

The following description is provided to enable those skilled in the art to make and use the described embodiment set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1A:
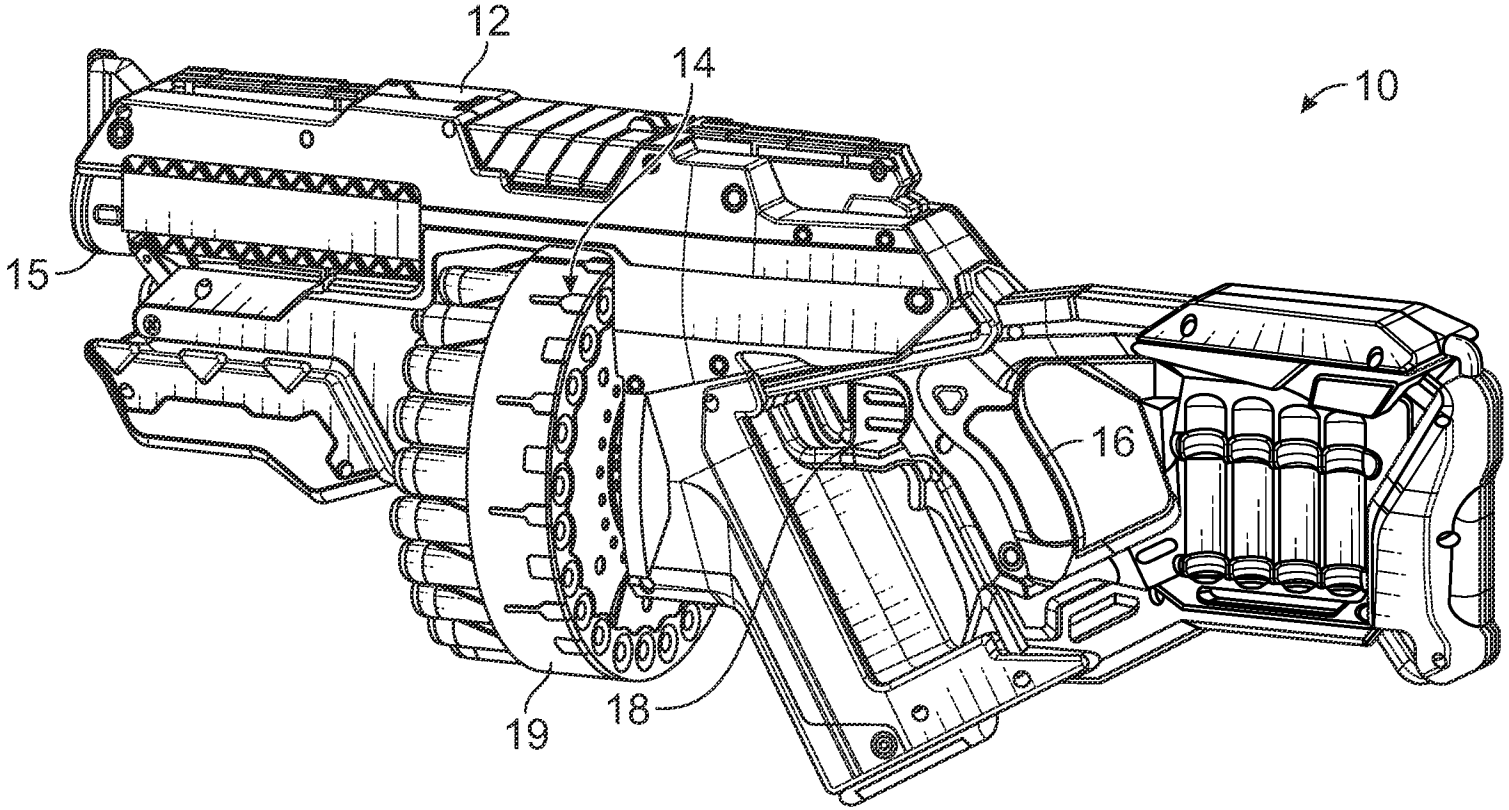
FIG. 1A is a perspective view of a toy launch apparatus embodiment and FIG. 1B illustrates the launch apparatus having a housing half removed to reveal internal structures, with FIGS. 1C and 1D showing the multiple improvised projectile checking and locking features embodied with a present preferred embodiment, and FIG. 1E also showing an alternate embodiment positioning a locking key atop moving with the improvised projectile checking housing assembly in accordance with the present inventions.
Figure 1B:
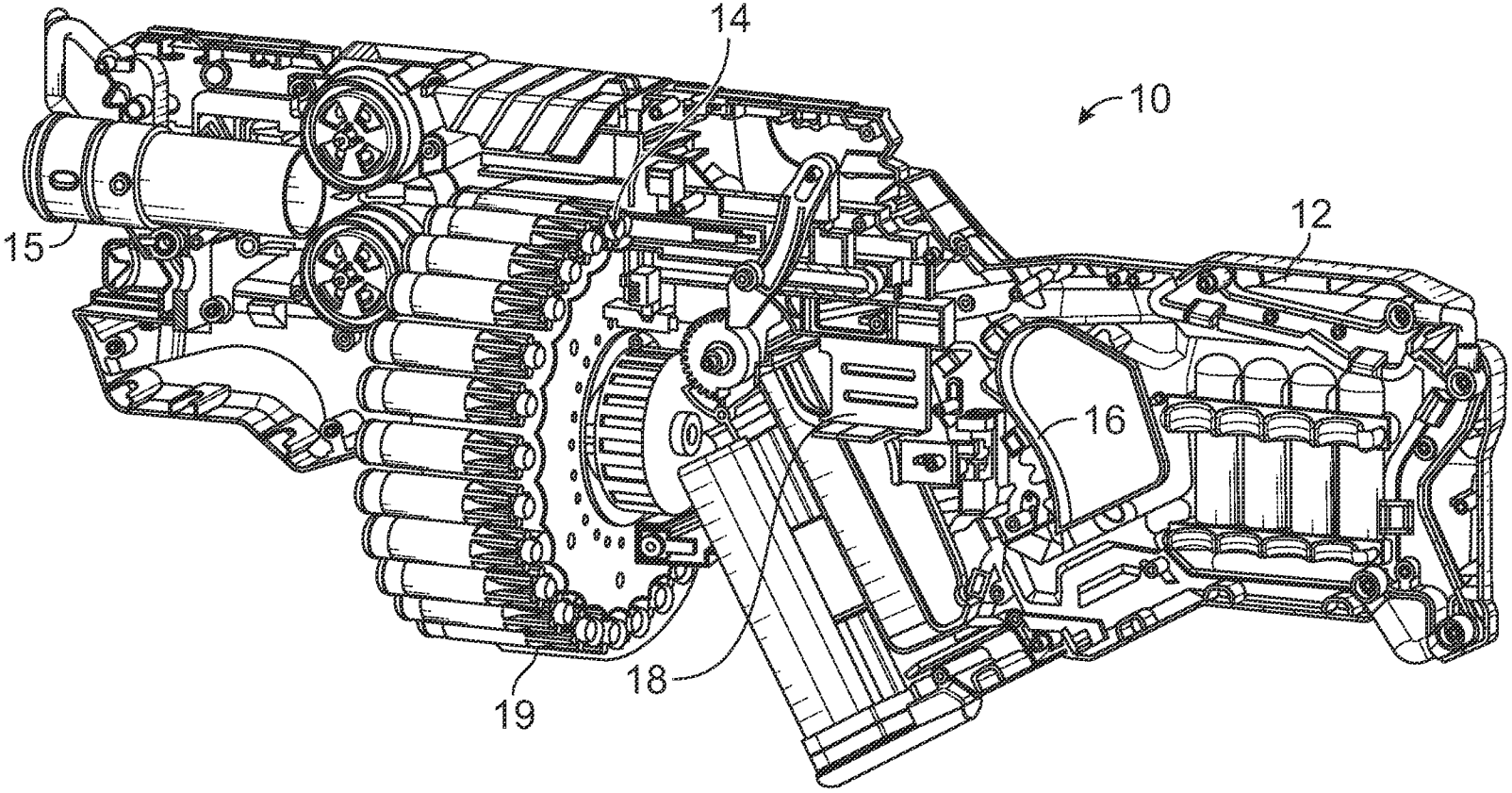

Referring now to FIGS. 1A and 1B, there is shown an embodiment of the invention in the form of a toy launch apparatus 10 having a housing assembly 12 including a barrel portion 14, a muzzle portion 15, a grip portion 16 and a trigger 18. The housing assembly 12 may be molded in two parts. The launch apparatus 10 is constructed for discharging a projectile of predetermined dimensions, and has safety features to prevent other objects from being inserted and discharged. Such acceptable projectiles are shown with projectile reference nos. 30, 32, 34, 36, and 38, in FIGS. 2C through 2F discussed below, having a soft weighted tip portion and rigid light-weight foam body material, including features such as a rearward nub 35 preventing launch apparatus 10 operation using improvised projectile checking housing assembly 20 for correspondingly structured and appropriately sized projectiles. Such features include requiring the corresponding stepped end 33 and nub 35 present at a projectile receiving opening 42. A step structure 40 surface of a projectile retaining element 19 is provided for contacting rearward stepped fins 33 for detecting offset dual parallel surfaces on backside of the dart at reference numbers 33 and 35. The nub 35 portion of appropriate projectiles extends into the projectile receiving opening 42.

FIG. 1A is a perspective view of a toy launch apparatus 10 embodiment and FIG. 1B illustrates the launch apparatus having a housing half removed to reveal internal structures for multiple improvised projectile checking and locking features embodied with a present preferred embodiment. The toy launch apparatus 10 includes the projectile retaining element 19 with a projectile barrel assembly 14. The projectile retaining element 19 is shown as a dart projectile drum but may be provided as a rotating barrel, dart magazine or projectile clip structure. The projectile retaining element 19 is provided further with the projectile barrel assembly 14 area extending rearward the projectile retaining element 19 with the improvised projectile checking housing assembly 20 of the projectile barrel assembly 14 movable between checking and non-checking positions. An elongated structure 24 is moveably positioned in the improvised projectile checking housing assembly 20 to check the step structure 40.

The step structure 40 of the projectile barrel assembly creates a projectile receiving opening 42 at the interface of the projectile retaining element 19 and the improvised projectile checking housing assembly 20. The projectile receiving opening 42 allowing an appropriate size projectile with a corresponding step 40 present with the rearward nub 35 at the projectile receiving opening 42 of the improvised projectile checking housing assembly 20 thus preventing another projectile from the projectile receiving opening 42. An improvised projectile button 26 is positioned at the end of the elongated structure 24 at IP checking housing collar 27 for checking the rearward nub 35 discussed further below.

An improvised projectile checking spring 28 is mounted to the improvised projectile button 26 with the end of the elongated structure 24, having the improvised projectile button 26 positioned for checking at the projectile receiving opening 42 with reference to FIGS. 1C, 1D, 2A and 2B discussed below. Extending rearward of the projectile retaining element 19, the improvised projectile checking housing assembly 20 has the button 26 and first and second sidewalls 22A/22B with first and second catch latch apertures 23A/23B opening to a catch 25 latch recess of elongated structure 24 using an improvised projectile checking spring 28 opening to receive a locking key 44 structure based upon the projectile receiving opening 42 to the improvised projectile checking housing assembly 20, such that IP detection checks the dart pusher using the key 44 with catch 25. Accordingly with the projectile receiving opening 42 at the interface of the projectile retaining element 19, the improvised projectile checking housing assembly 20, the improvised projectile button 26 and elongated structure 24 move between checking and non-checking positions and prevent trigger movement unless the appropriate sized projectile is present by detecting offset dual parallel surfaces on backside of dart, such as those illustrated in FIGS. 2C through 2G below embodiments of dart projectile designs with rearward stepped structures such as fins 33 and nub 35 portions.

For example, the projectile 30 can include a stepped end 33 and a nub 35, such that when the stepped end and nub are present at a projectile receiving opening with any corresponding step, e.g., allowing rearward stepped structure fins 33 portions as discussed for appropriate projectiles at the projectile receiving opening, such that detection checks are triggered. In the alternate embodiment of FIG. 2G, the projectile 34 has a solid core 68 can extend outwardly from the hollow portion 70 of the body, such that the hollow portion 70 surrounds a portion of the solid core 68. The overall length of the extension can be varied depending on the overall desired length of the projectile 60, and needed compatibility with the particular launching apparatus with which the projectile 60 is to be used. In embodiments, the projectiles can include features to allow it to be used with launchers having an improvised projectile checking housing structure such as described in U.S. provisional and design application Nos. filed concurrently herewith.

Figure 2A:
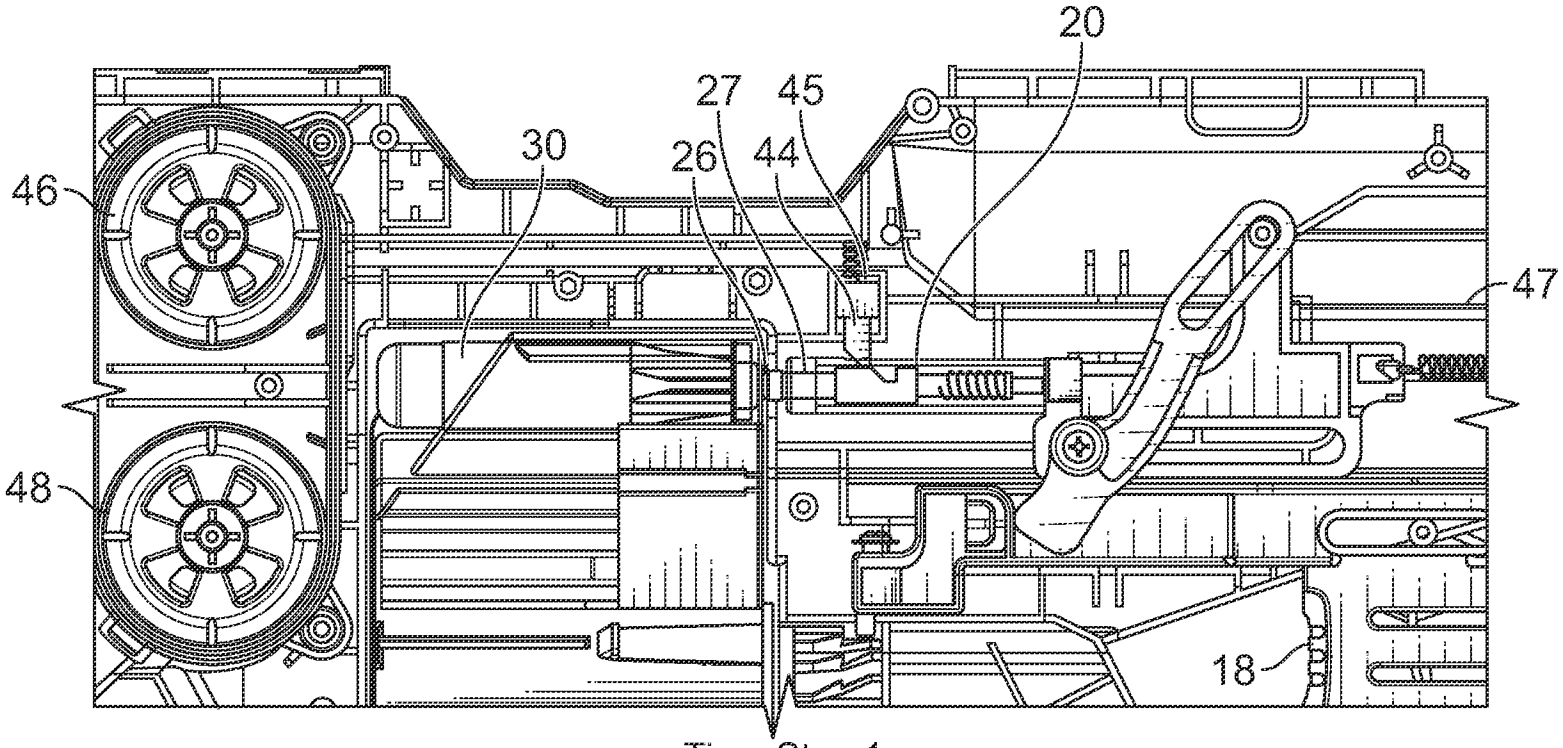
FIGS. 2A and 2B are exposed side elevational and perspective views of a toy projectile apparatus with multiple improvised projectile features about to be checked for the launch apparatus shown in FIGS. 1B-D.
Figure 2B:
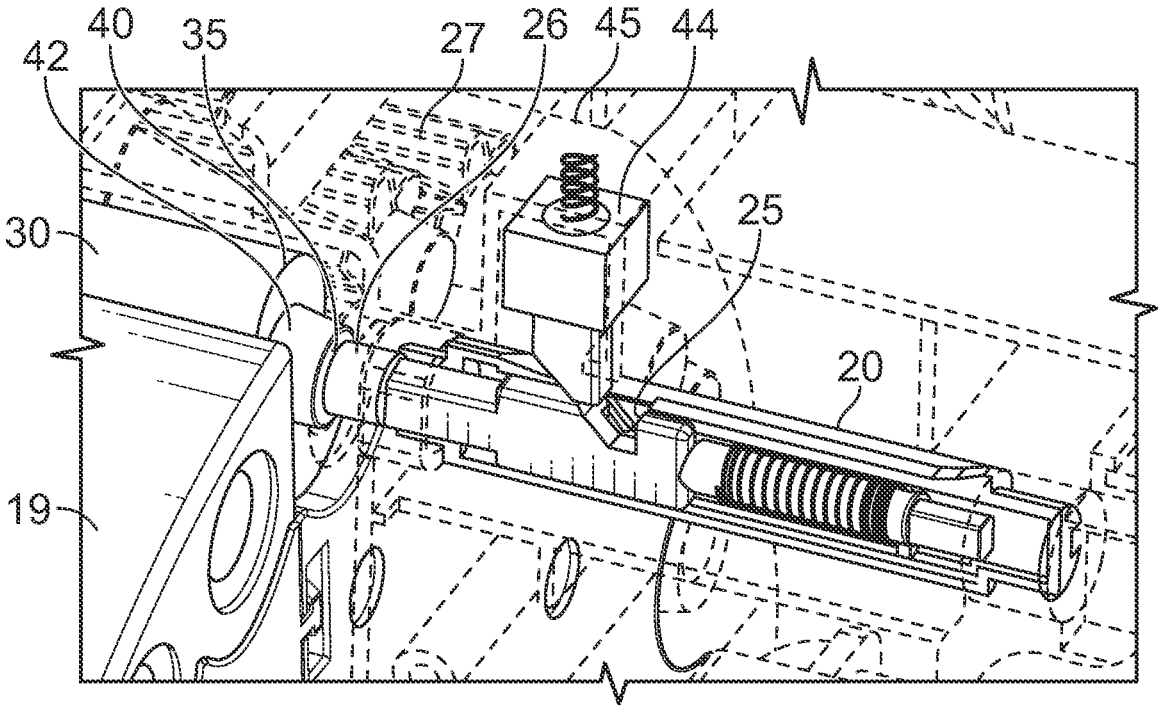
Figure 2C:
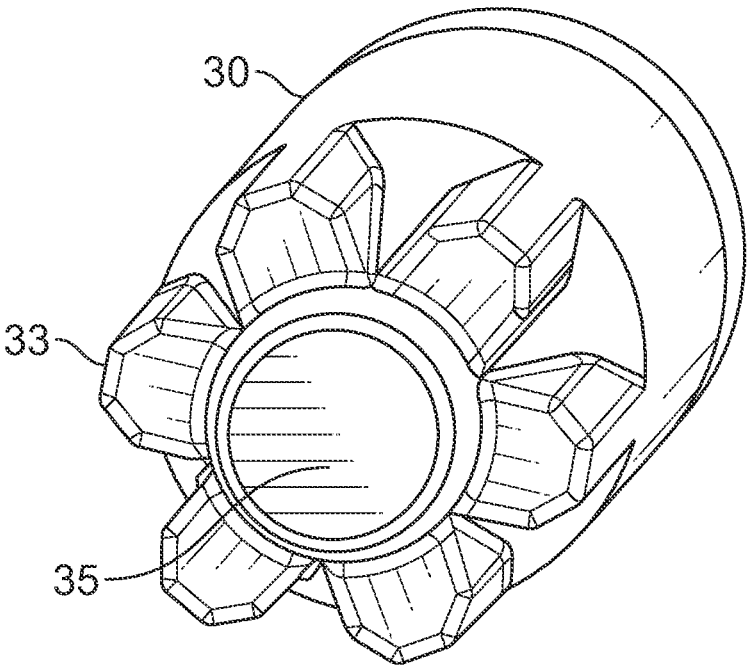
FIGS. 2C through 2G provide views of dart projectile designs with rearward stepped fins and nub portions of acceptable projectiles for the launch apparatus using improvised projectile checking housing assembly for correspondingly structured and appropriately sized projectiles with a corresponding feature present at a projectile receiving opening with a corresponding step.
Figure 2D:
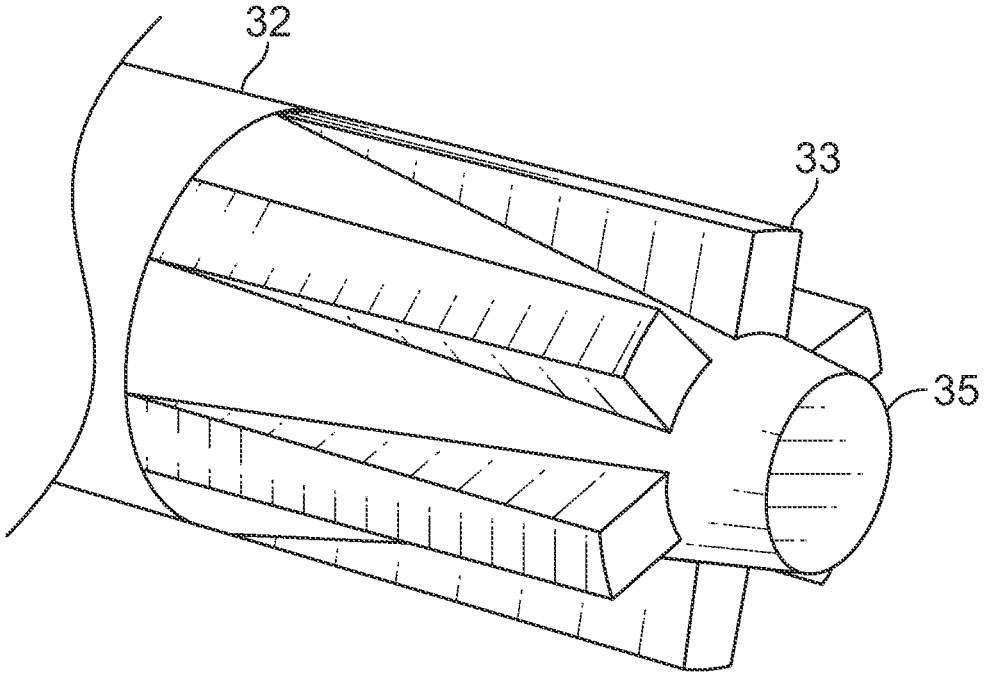
Figure 2E:
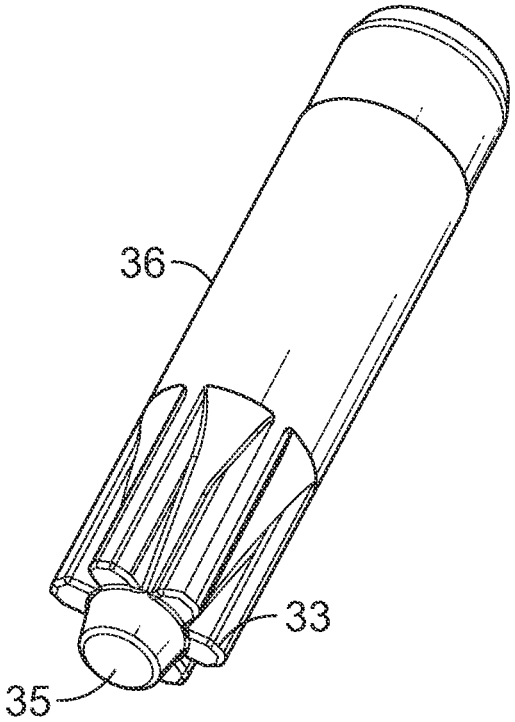
Figure 2F:
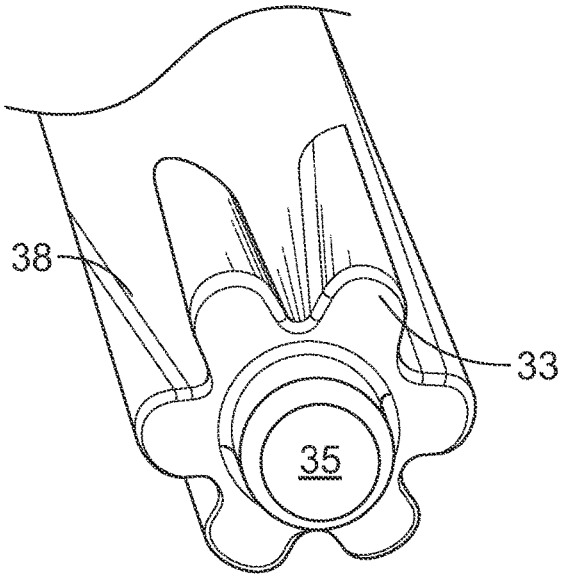
Figure 2G:
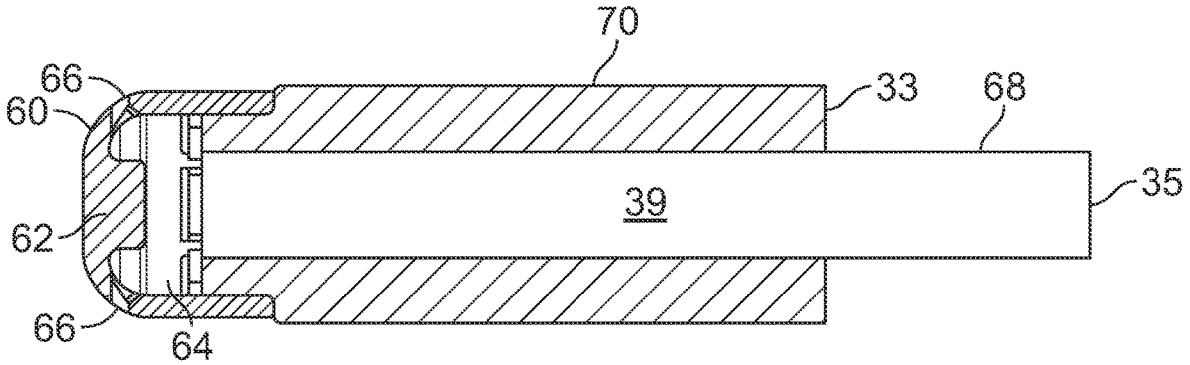

As seen in FIG. 2G, the alternate dart 34 includes a tip 60 which includes internal projections 62 into an internal chamber 64 into which the projections 62 extend. The internal chamber 64 is vented by one or more vent holes 66 disposed in the tip 60. The vent holes 66 can be positioned variously on the tip 60 so long as they are in fluid communication with the internal chamber 64. The vent holes 66 allow air from within the internal chamber 64 to escape upon impact of the tip against a surface, to thereby allow the outer walls of the tip 60 to expand outwardly such that the tip 60 impact area expands upon contact. This allows for increased impact area, which can further aid in keeping a kinetic energy density (KED) within toy safety standard, while allowing the projectile to be launched with increase velocity. Thus a projectile with a light weight body, yet a large impact producing tip area and relatively heavier tip may provide advantageous flight characteristic, while soft highly flexible durometer materials provides acceptable KED. Hazard evaluation of improvised projectile (IP) includes preventing the insertion or loading of inappropriate objects to prevent launched improvised projectiles may include but is not limited to tip 60 relative to kinetic energy.

Figure 1C:
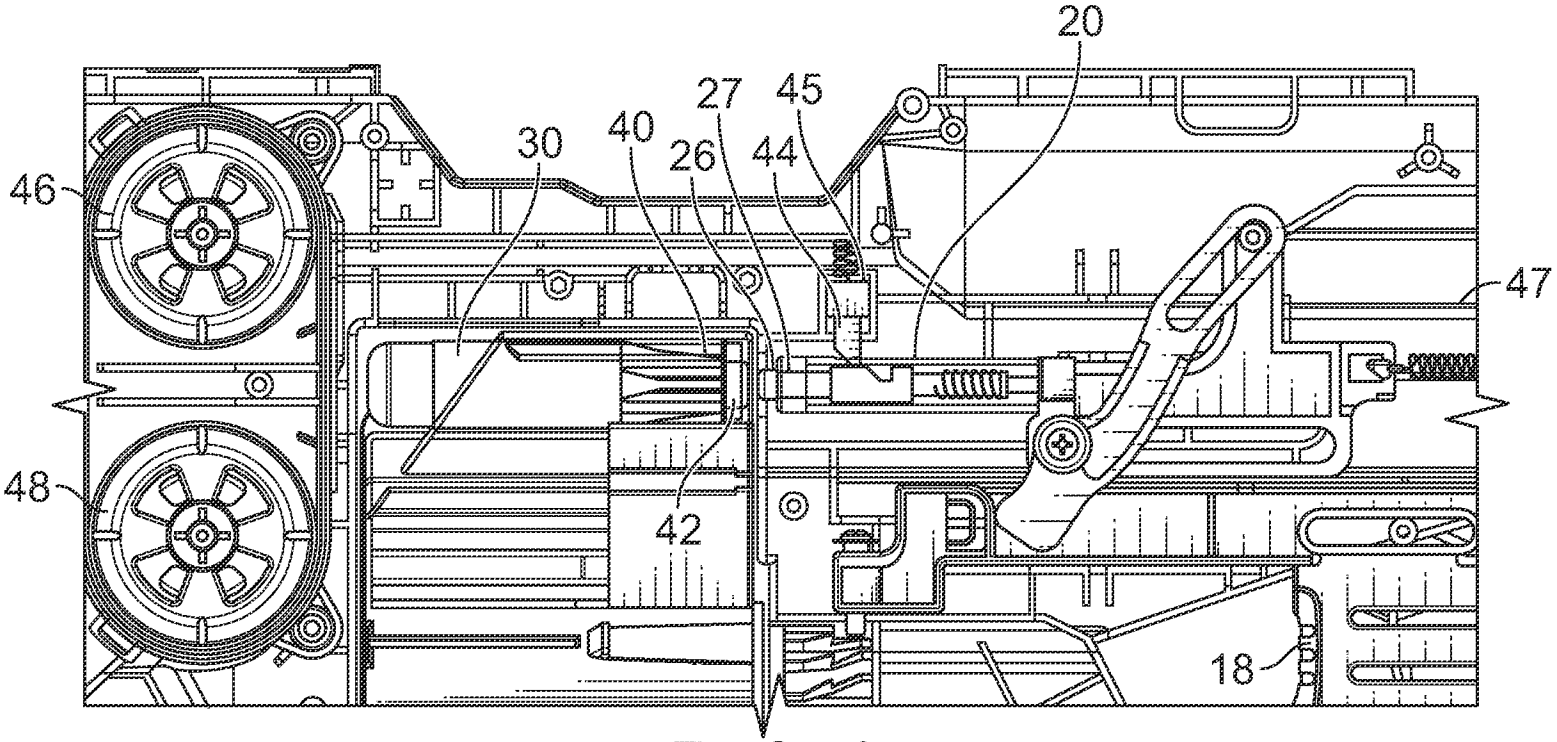

FIG. 1C is a side view that illustrates the projectile barrel assembly 14 extending rearward the projectile retaining element 19 with an improvised projectile checking housing assembly 20 of the projectile barrel assembly 14 movable between checking and non-checking positions, and is shown at rest. In Time Step 0, there is the opening 42 on the housing relative to catch 25 opening in the IP housing, with no pressure on the trigger 18, with a single dart loaded into the projectile retaining element 19, and the IP lock key 44 riding the top of the IP detector housing 20 following its contour, as shown in FIG. 2B discussed below. A lock spring 45 downwardly biases the IP lock key 44. A trigger return spring 47 rearwardly biases the trigger 18 and the connected trigger linkages. As discussed herein, the IP detector button 26 is positioned to be pushed into housing 20 at IP checking housing collar 27 maintaining the elongated structure 24 for registration with the catch latch apertures, the apertures 23A/23B to completely close so the lock key 44 may ride over the IP detector housing 20 without dropping into the catch 25 latch recess of elongated structure 24.

Figure 1D:
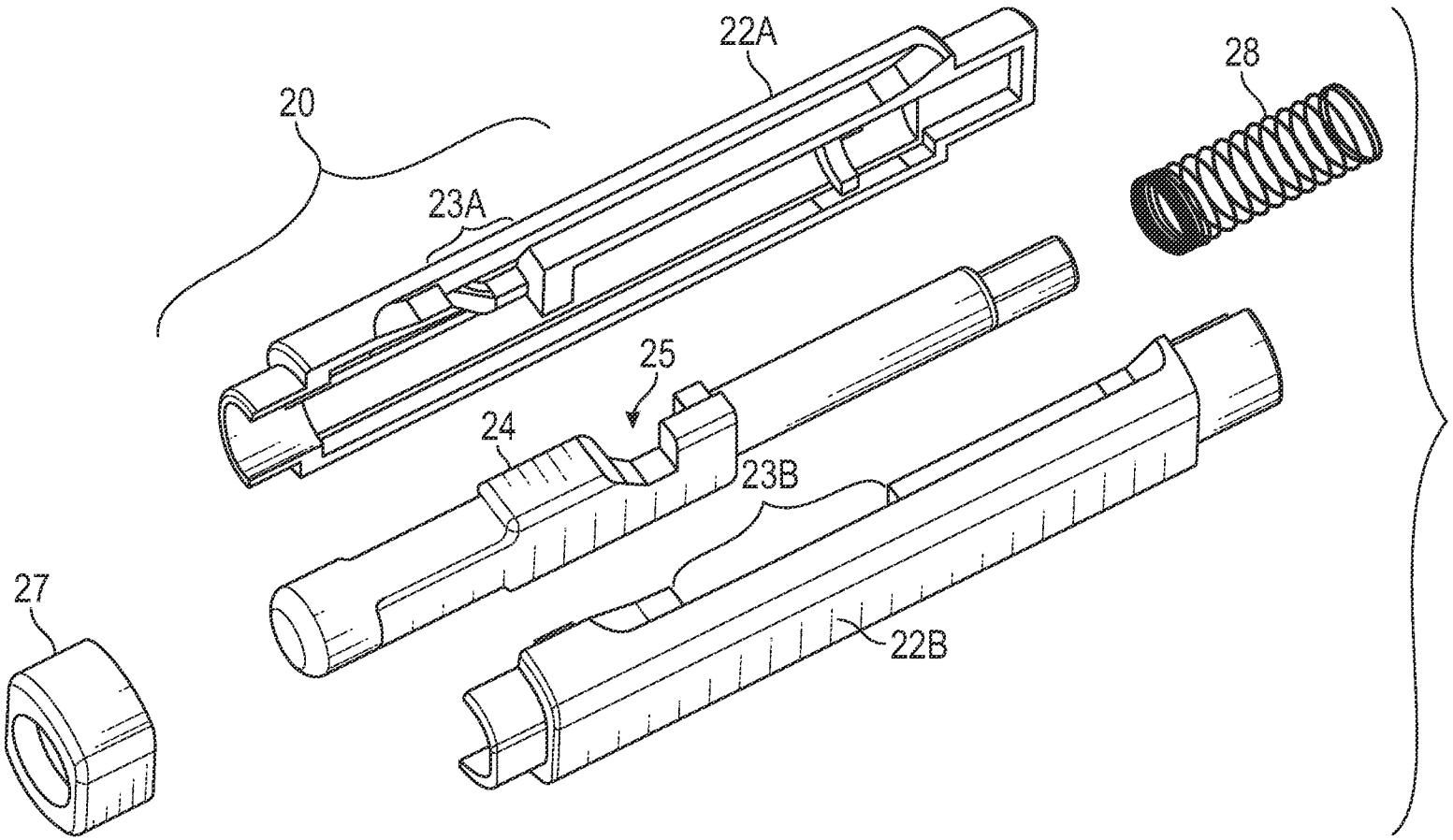
Figure 1E:
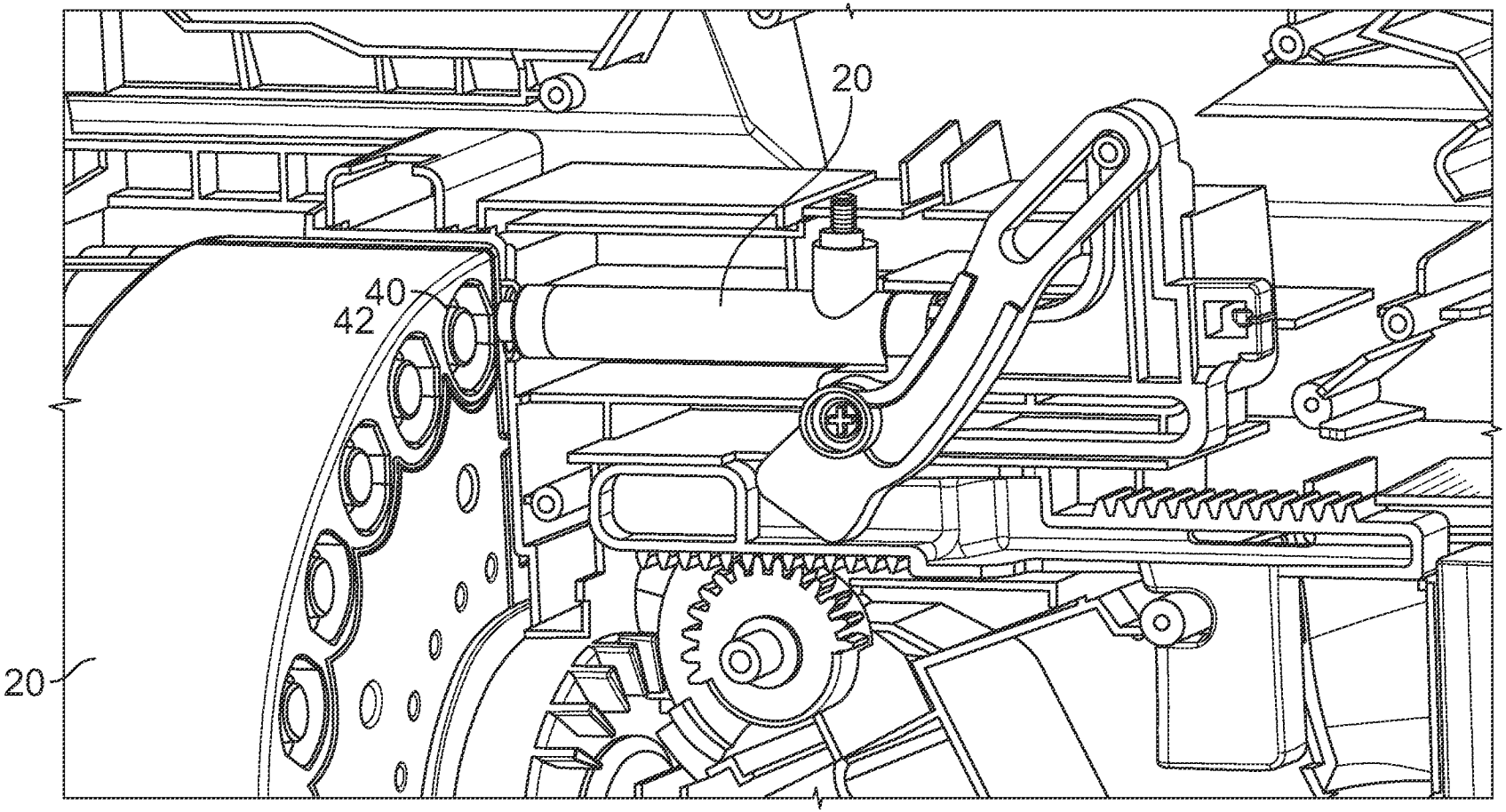

FIG. 1D button 26 and first and second sidewalls 22A/22B with first and second catch latch apertures 23A/23B open to the latch recess catch 25 of elongated structure 24 using an improvised projectile checking spring 28. The elongated structure 24 has proximal and distal ends thereof and the catch 25 latch recess there between. The exploded view componentry shows the openings at apertures 23A/23B for respective first and second sidewalls 22A/22B. Thus the improvised projectile checking housing 20 provides a catch latch aperture rearward from the projectile receiving opening 42 used with the improvised projectile checking housing assembly 20 where elongated structure 24 resides between the first and second sidewalls 22A/22B thereof to check the projectile receiving opening 42 and accordingly the step structure. FIG. 1E also shows a different alternate embodiment positioning a locking key 44 atop moving with the improvised projectile checking housing assembly 20 in accordance with the present embodiments.

FIGS. 2A and 2B are exposed side elevational and perspective views of a toy projectile apparatus with multiple improvised projectile features about to be checked for the launch apparatus shown in FIGS. 1B-D. In FIG. 2B the side view that illustrates the improvised projectile checking housing assembly 20 about to check, in Time Step 1, with slight pressure on the trigger 18 to remove slack and have IP button 26 in contact with dart. The dart has not moved and has no pressure on it yet; the IP detector lock key 44 rides the top of the IP detector button 26. Still, in Time Step 1, the movement of the housing at this time is moving forward because the IP catch 25 is not forward enough to be aligned with first and second catch latch apertures 23A/23B. IP button 26 and housing 20 are simultaneously translated forward together to remove the slack and check for the presence of the correct dart.

The trigger 18 assembly provides movement of the improvised projectile checking housing with the improvised projectile button 26 from the elongated structure 24 proximal end with the improvised projectile checking spring 28 towards the projectile receiving opening 42 of the improvised projectile checking housing assembly 20. The locking key 44 structure is positioned rearward from the projectile receiving opening 42 to the improvised projectile checking housing assembly 20, intermediate the proximal and distal ends of the elongated structure 24, and opposing the first and second catch latch apertures 23A/23B of the first and second sidewalls 22A/22B for preventing further movement of the improvised projectile checking housing unless the appropriate size projectile is present at the projectile receiving opening 42 of the improvised projectile checking housing assembly 20. Alternatively stated, with the detection of a proper projectile, the trigger assembly 18 is able to move the projectile into the launching structure because the locking key 44 slides over the first and second side walls 22A/22B. However, with an improper projectile, a locking structure 44 is biased towards/into the aperture 23A/23B to therefore engage the housing assembly 20, thus preventing further movement of the housing assembly 20 in a direction towards the launching structure.

FIGS. 2C through 2F provide views of dart projectile designs with rearward stepped fins 33 and nub 35 portions of acceptable projectiles 30, 32, 34, 36, and/or 38 for the launch apparatus using improvised projectile checking housing assembly 20 for correspondingly structured and appropriately sized projectiles with a corresponding feature present at a projectile receiving opening 42 with a corresponding step 40. The rearward stepped fins 33 and nub 35 portions may be formed with either sharp edges, rounded or tapered edges for complementary use for with the corresponding step present at the projectile receiving opening of the improvised projectile checking housing assembly 20 as discussed. Further if the rearward nub 35 object is too soft, or of the incorrect diameter, the nub 35 structure may not be allowed or able to pass improvised projectile checking. With an alternative shaped nub, it is also contemplated as shown in the FIG. 2G dart projectile design with its rearward step and nub portions, where the body may include a hollow portion with a solid core 68 inserted into the hollow portion 70. In embodiments one or both of the solid core and the hollow portion. The darts herein described may be formed using a variety of processes and materials, including but not limited to solids, foam, extruded plastics and/or foam materials as hollow or tubular structures or conventional NERF™ brand dart materials.

Figure 3A:
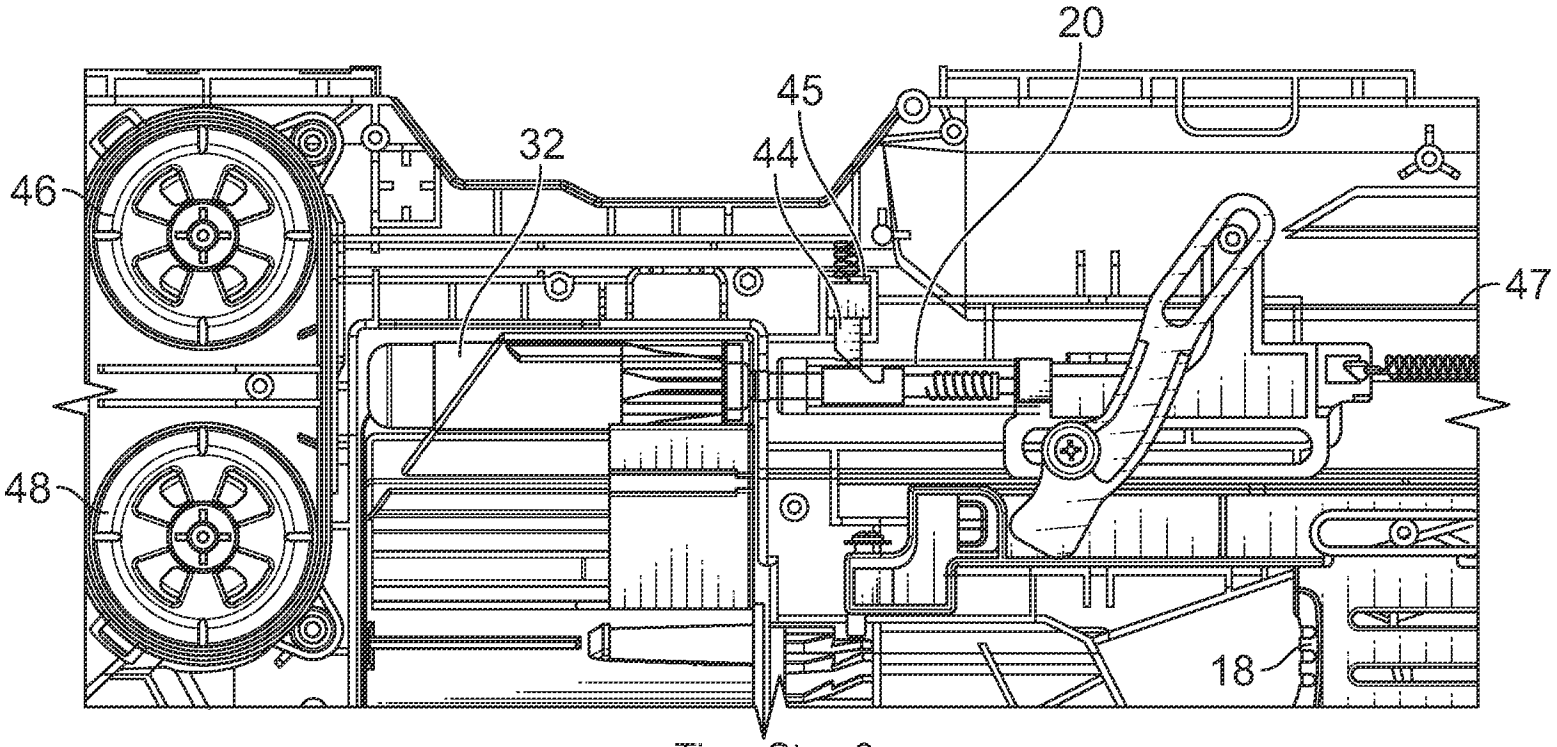
FIGS. 3A and 3B are exposed side elevational and perspective views of a toy projectile launch apparatus checking the appropriate size projectile present at the projectile receiving opening of the improvised projectile checking housing assembly checking for an improvised projectile while pushing the loaded projectile in accordance with the present inventions.
Figure 3B:
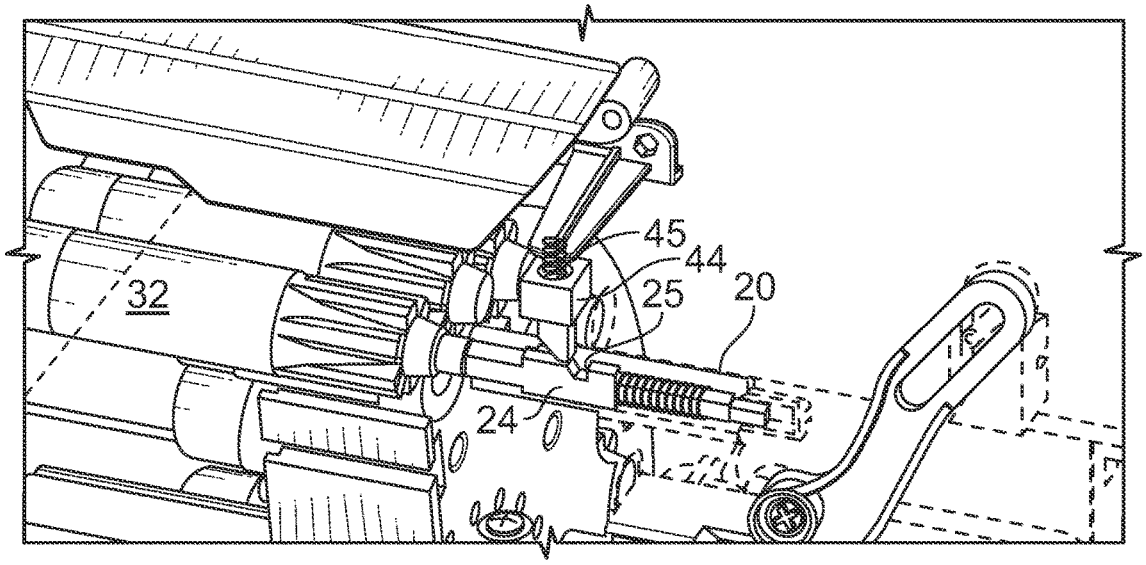

FIGS. 3A and 3B are exposed side elevational and perspective views of a toy projectile launch apparatus checking the projectile present at the projectile receiving opening 42 of the improvised projectile checking housing assembly 20 while pushing the loaded projectile in accordance with the present embodiments. FIG. 3B (at Time Step 2) illustrates the side view with slight pressure on the trigger 18 to engage and push IP detector system, having the IP detector button 26 retracted into IP detector housing via pressure on dart, with the IP detector lock riding the top of the IP detector button 26. The IP housing and IP button 26 with first and second catch latch apertures 23A/23B positioned as misaligned in relation to the IP catch 25 are thus blocking the IP lock key 44 from engaging with the IP catch 25. Otherwise with the incorrect dart with an improper nub or no dart, the downwardly biased lock would soon engage with alignment of first and second catch latch apertures 23A/23B opening the resulting aperture in relation to the IP catch 25 thus locking downwardly biased IP lock key 44 as engaging in the IP catch 25.

Figure 4:
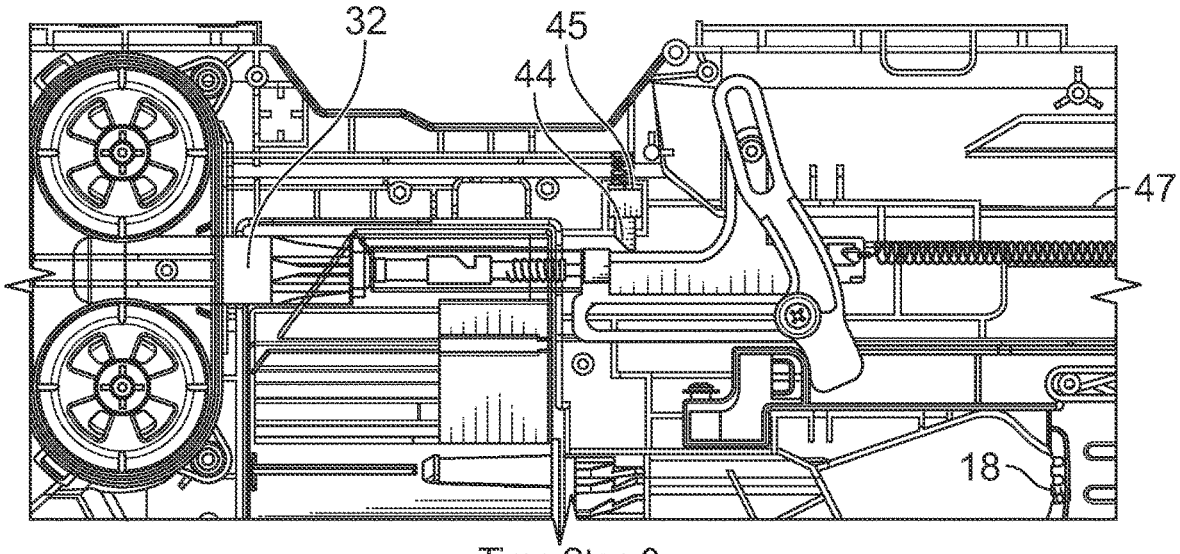
FIG. 4 is a side elevational view of a toy projectile apparatus pushing the loaded appropriate authorized projectile into motor driven rotating flywheels for motor driven projectile propelling in accordance with the present inventions.

FIG. 4 is a side elevational view of a toy projectile apparatus pushing the loaded appropriate authorized projectile into motor driven rotating flywheels 46/48 for motor driven projectile propelling in accordance with the present embodiments. The authorized dart is maintained in the projectile retaining element 19 with an interference fit or friction fit as between the dart body and the projectile retaining element 19 to allow for checking the projectile and particularly nub 35 at the projectile receiving opening 42. To this end, in FIG. 4 the side view illustrates the improvised projectile checking housing assembly 20 checked and advancing, in Time Step 3 with the dart checked and pushing into flywheels 46/48, advancing full pressure on the trigger 18 to push dart into flywheels 46/48, with the IP detector lock riding the top of the trigger 18 linkage. Thereafter when trigger 18 pressure is removed, system will rest to Time step 0.

Figure 5A:
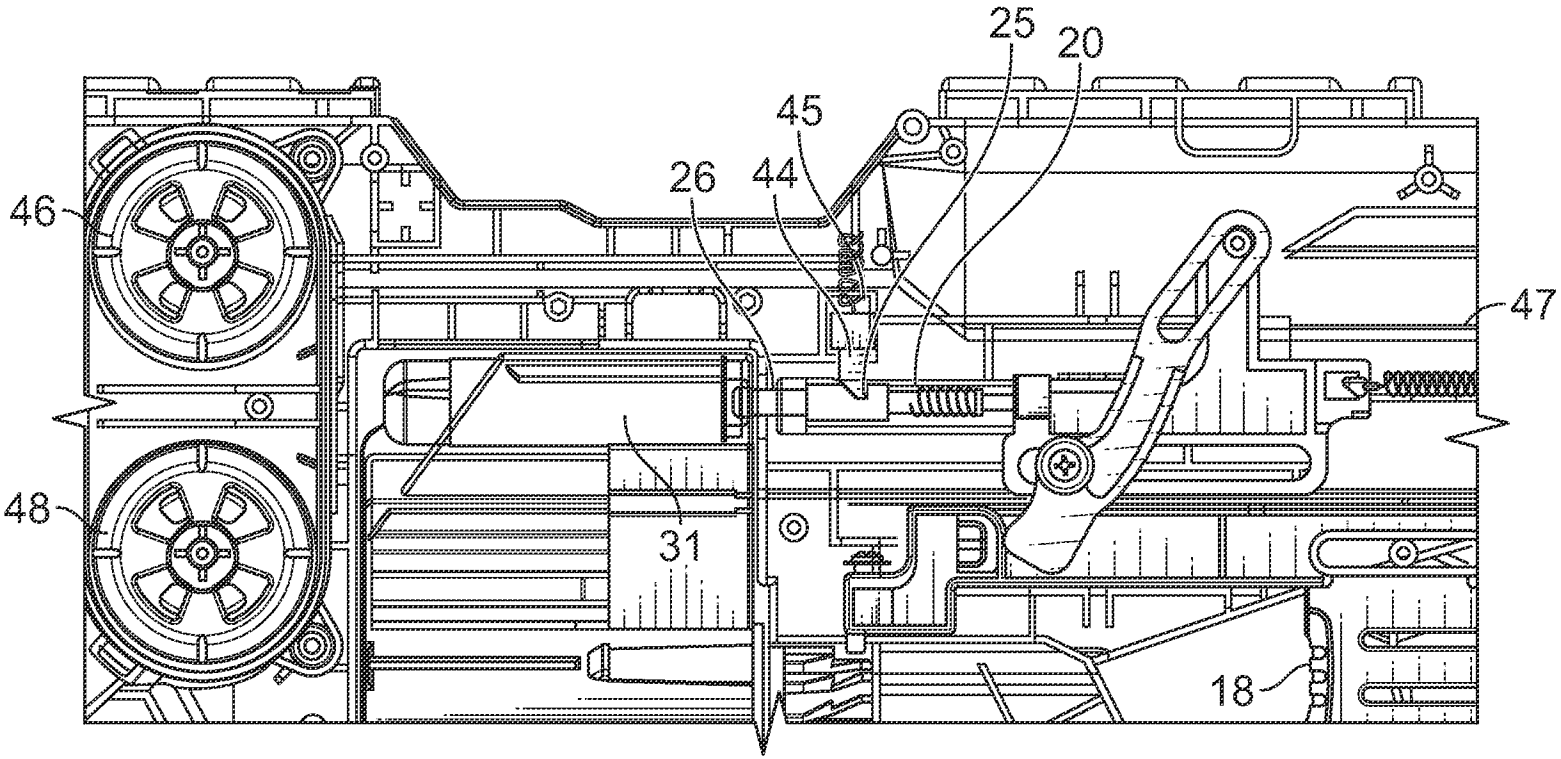
FIGS. 5A and 5B are exposed side elevational and perspective views of a toy projectile launch apparatus shown as preventing insertion, loading of inappropriate objects, preventing further movement of the improvised projectile checking housing without the appropriate size projectile is present at the projectile receiving opening of the improvised projectile checking housing assembly in accordance with the present inventions.
Figure 5B:
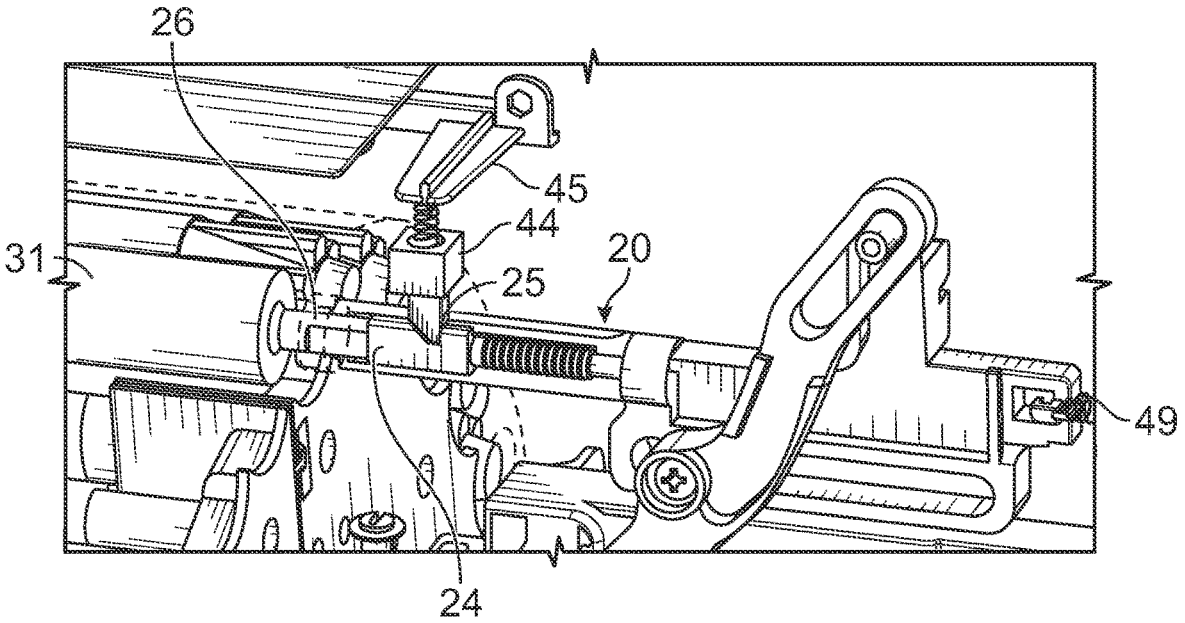

FIGS. 5A and 5B are exposed side elevational and perspective views of a toy projectile launch apparatus shown as preventing advancement of inappropriate objects, or a non-authorized tubular projectile with as shown, a hollow central core. Thus the inappropriate projectile prevents further operation of the launch apparatus based on the checked opening 42 of the improvised projectile checking housing assembly 20, and showing further having the trigger 18 locked with its downwardly biased IP lock key 44. Specifically, with the absence of an appropriately dimensioned numb structure on projectile, there is no structure to push against IP button 26 in a rearward direction against force of spring 28. As trigger 18 advances improvised projectile housing 20, apertures 23A/23B expose IP lock catch 25 to downwardly biased lock 44 permitting engagement of IP lock 44 in catch 25 before first and second catch latch apertures are able to move over and cover IP catch 25, thereby preventing engagement. In FIGS. 5A and 5B the views illustrate the improvised projectile checking housing assembly 20 check indicating an incorrect dart or no authorized dart, and at this step with full pressure on the trigger 18, IP lock key 44 inserted into IP lock catch 25, loading of inappropriate objects, or a non-authorized tubular projectile with a hollow central core thus further preventing operation of the launch apparatus based on the checked opening 42 of the improvised projectile checking housing assembly 20, the IP lock key 44 locks the trigger 18 due to IP lock button 26 IP catch 25 and IP housing's IP catch being aligned.

Figure 6:
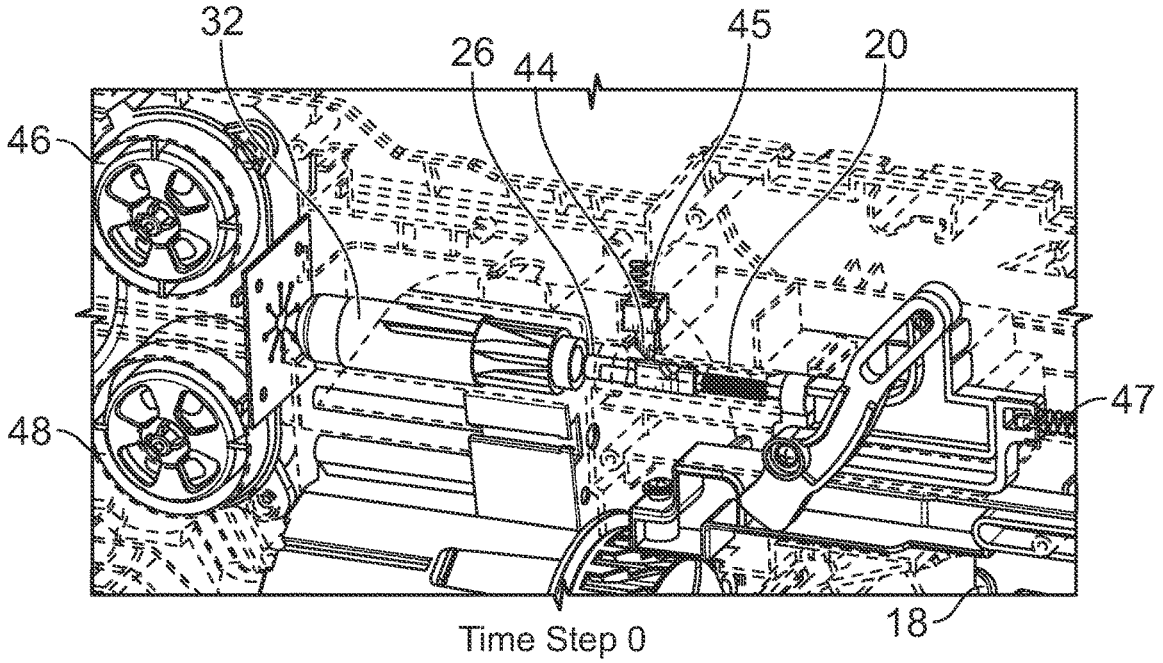
FIG. 6 is a perspective view of a toy projectile apparatus showing the IP locking key structure rearward from the projectile receiving opening to the improvised projectile checking housing assembly, with some internal elements removed for clarity.

FIG. 6 is a perspective view of a toy projectile apparatus showing the IP locking key 44 structure rearward from the projectile receiving opening 42 to the improvised projectile checking housing assembly 20, intermediate the proximal and distal ends of the elongated structure 24, where the launch apparatus is shown prior to checking the appropriate size projectile with the nub 35 of the projectile present at the projectile receiving opening 42 of the improvised projectile checking housing assembly 20 shown at rest, in Time Step 0, with the IP housing assembly 20 relative to catch opening aperture at rest.

Figure 7A:
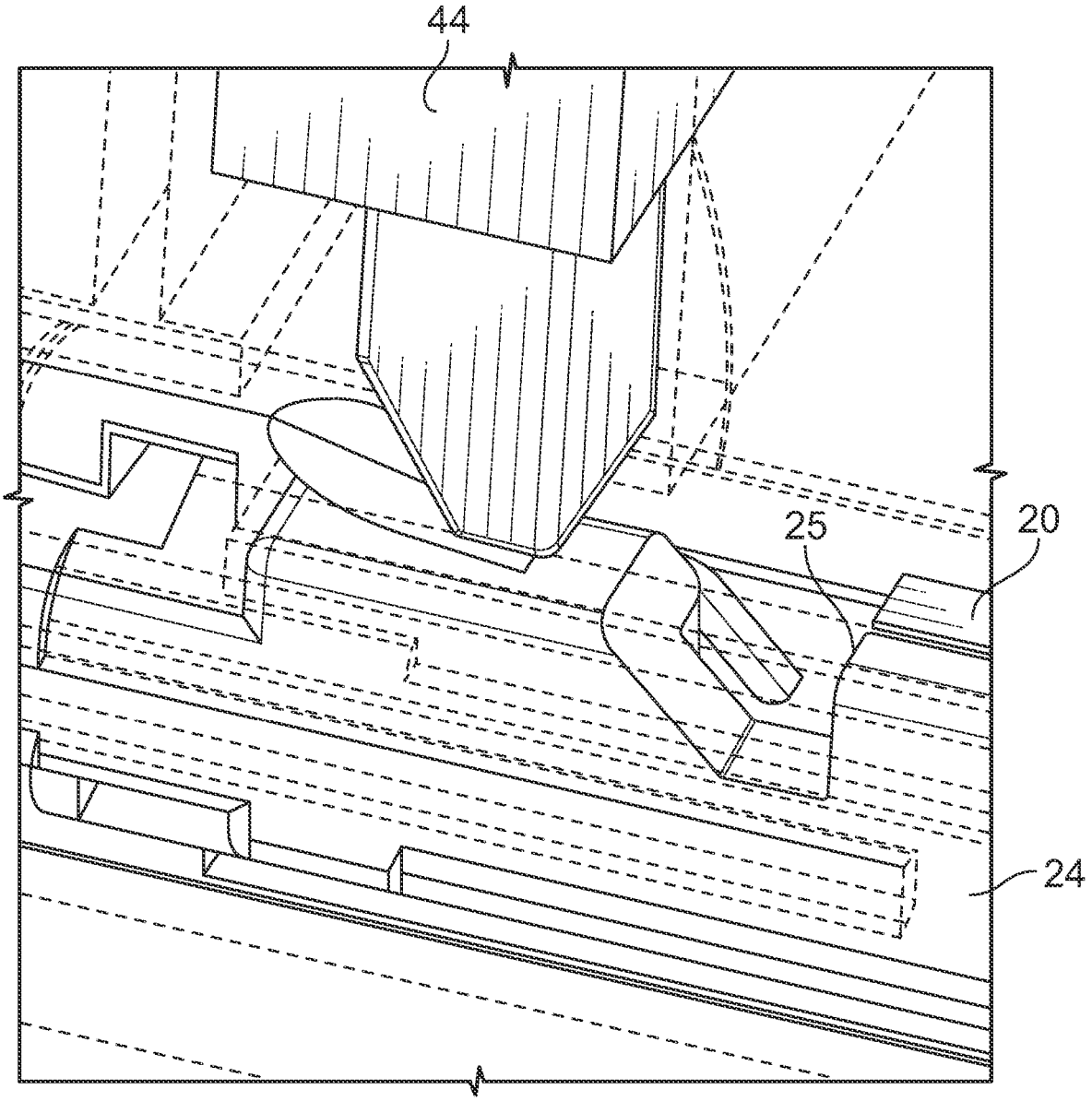
FIGS. 7A through 7D are enlarged perspective views, partially in section, showing respectively the IP locking key engaged having the launch apparatus and trigger as preventing insertion, loading of inappropriate objects, preventing further movement of the improvised projectile checking housing, with first and second catch latch apertures opening to a catch latch recess of elongated structure in accordance with the present inventions.
Figure 7B:
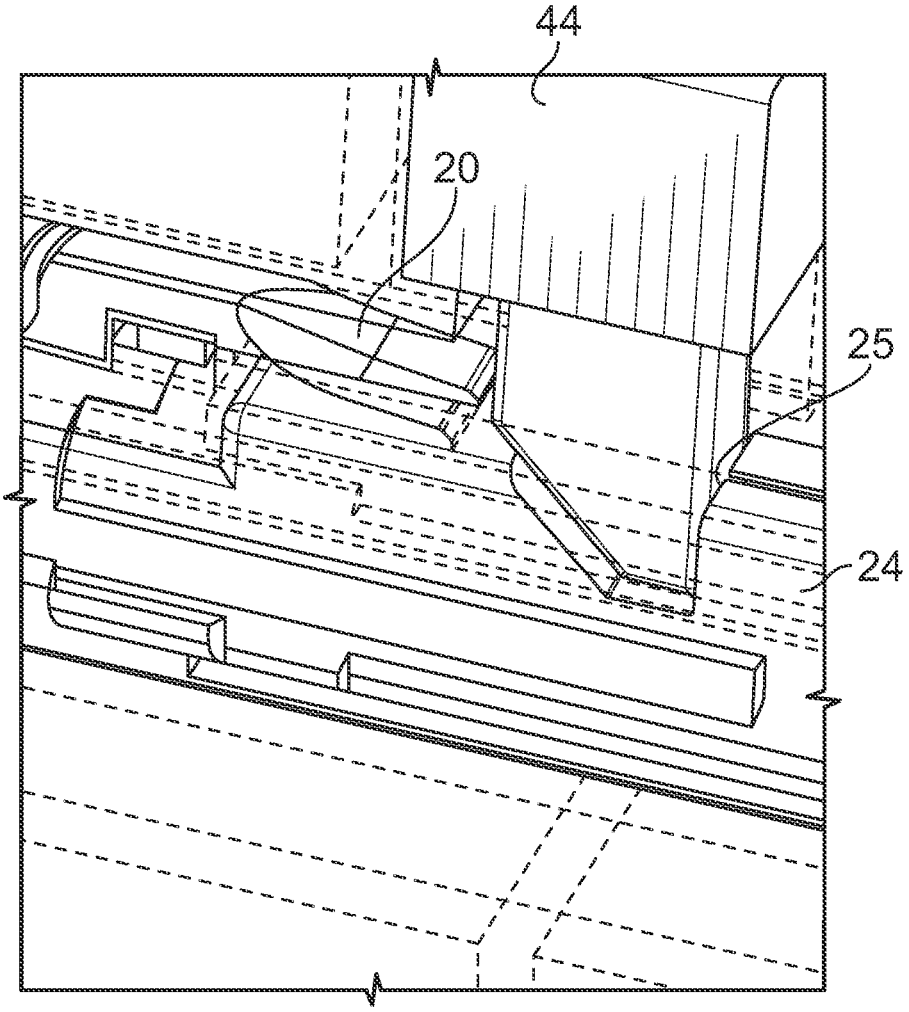
Figure 7C:
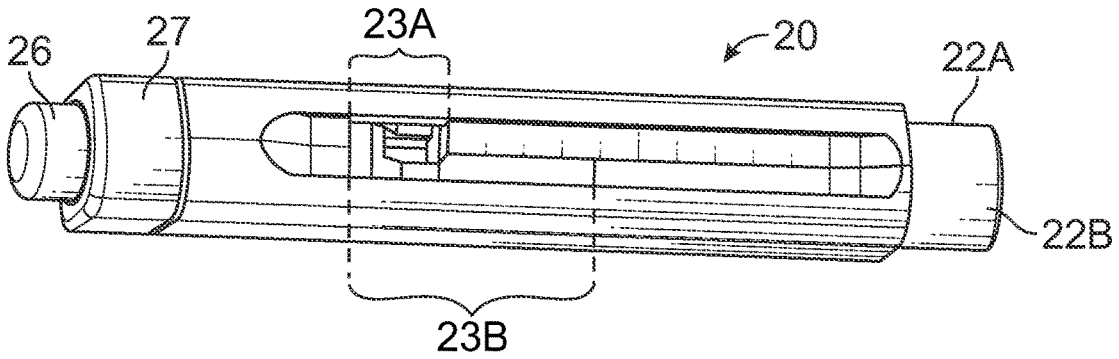
Figure 7D:
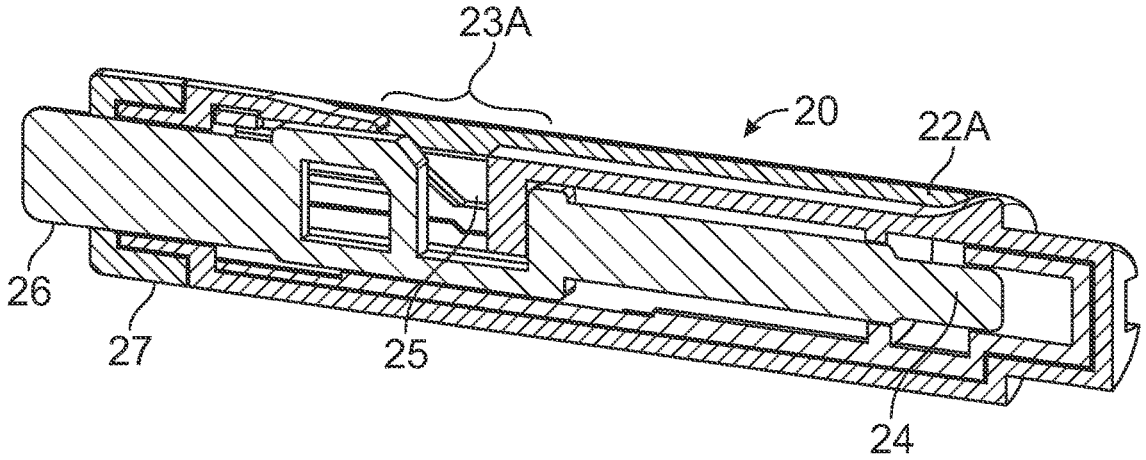

FIGS. 7A and 7B are enlarged perspective views, partially in section, showing respectively the IP locking key 44 engaged having the launch apparatus and trigger 18 as preventing insertion, loading of inappropriate objects, or a non-authorized tubular projectile with a hollow central core thus further preventing operation of the launch apparatus based on the checked opening 42 of the improvised projectile checking housing assembly 20, where opposing the first and second catch latch apertures 23A/23B of the first and second sidewalls 22A/22B for preventing further movement of the improvised projectile checking housing, with first and second catch latch apertures 23A/23B opening to a catch 25 latch recess of elongated structure 24 in accordance with the present embodiments. FIGS. 7C and 7D show the opening on the housing relative to catch opening in the IP housing 20.

Figure 8A:
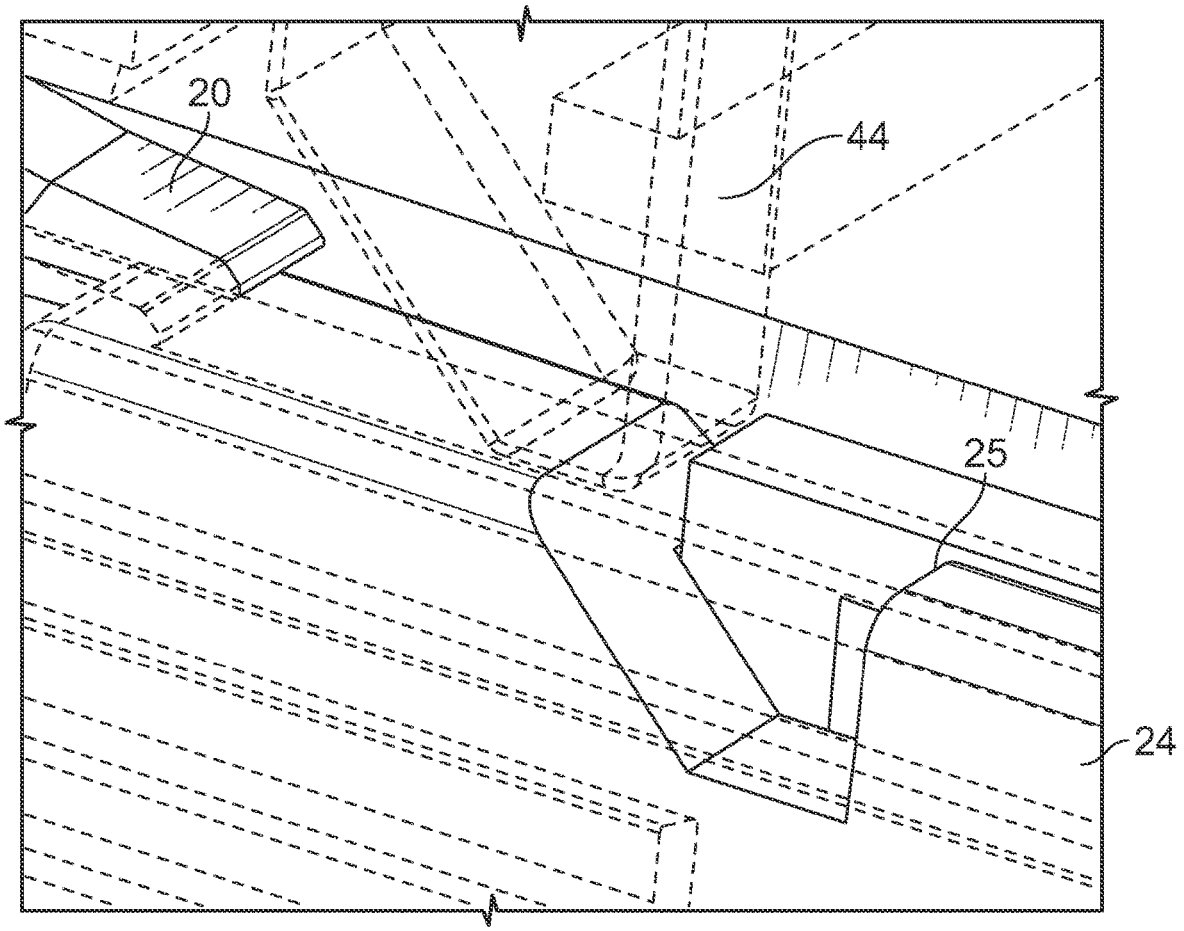
FIGS. 8A and 8B are enlarged perspective views, partially in section, showing the IP locking key with the lock closed and disengaged, having the first and second catch latch apertures closed off the catch latch recess of elongated structure in accordance with the present inventions.
Figure 8B:
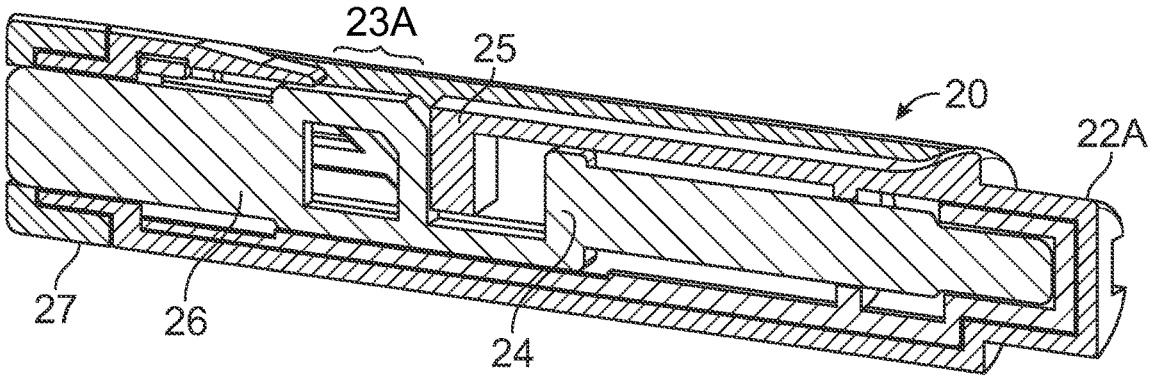

FIGS. 8A and 8B are enlarged perspective views, partially in section, showing the IP locking key 44 with the lock closed and disengaged, having the first and second catch latch apertures 23A/23B closed off the catch 25 latch recess of elongated structure 24 in accordance with the present embodiments. With reference to the length of the dart and particularly its nub 33, e.g., in the present embodiments the IP detector button 26 may be pushed into housing 20 on the order of approximately 4 mm inward for registration for maintaining alignment with the catch latch apertures, the apertures 23A/23B to completely close and the lock key 44 can ride over the IP detector housing 20 without dropping into the catch 25 latch recess of elongated structure 24.

Figure 9A:
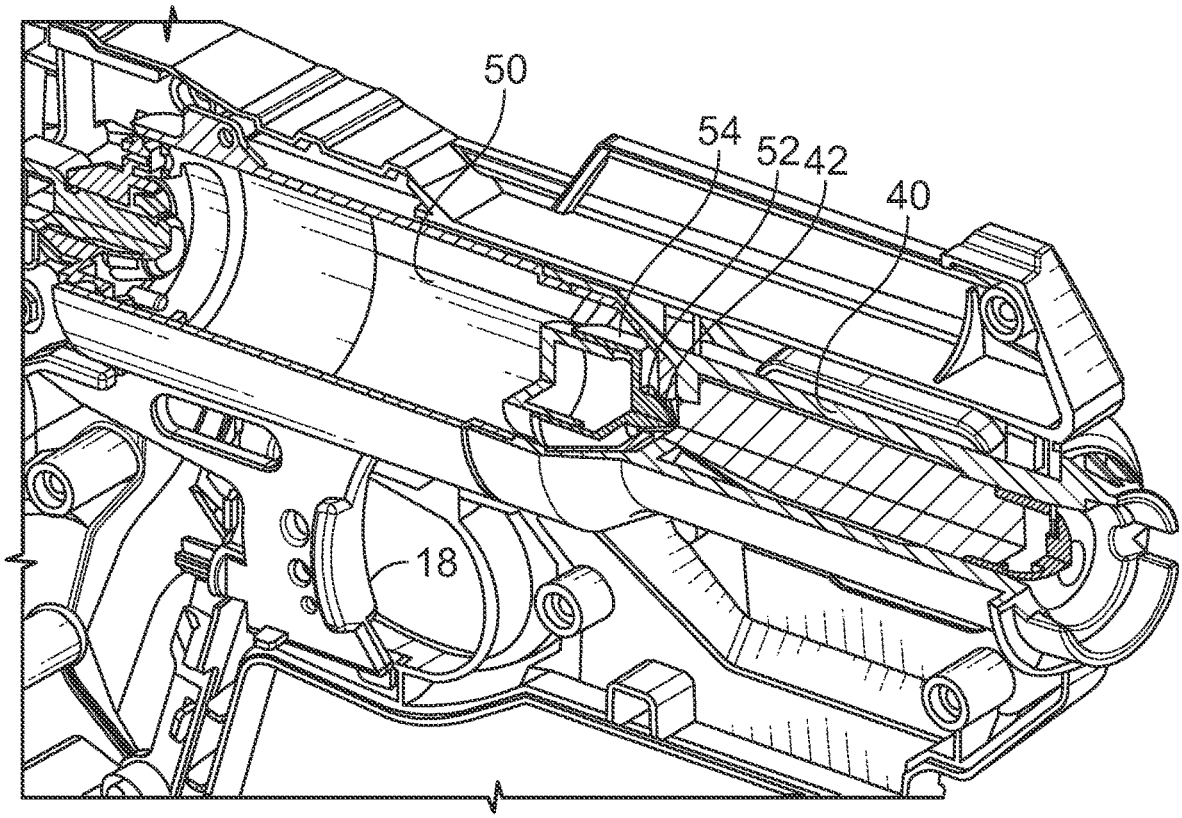
FIGS. 9A and 9B are exposed side elevational and perspective views, partially in section, of an alternate embodiment non-motorized toy projectile apparatus checking for an improvised projectile of the launch apparatus with an pneumatic air piston cylinder shown at rest without an inserted projectile present in FIG. 9B and showing an improvised projectile safety valve seat.
Figure 9B:
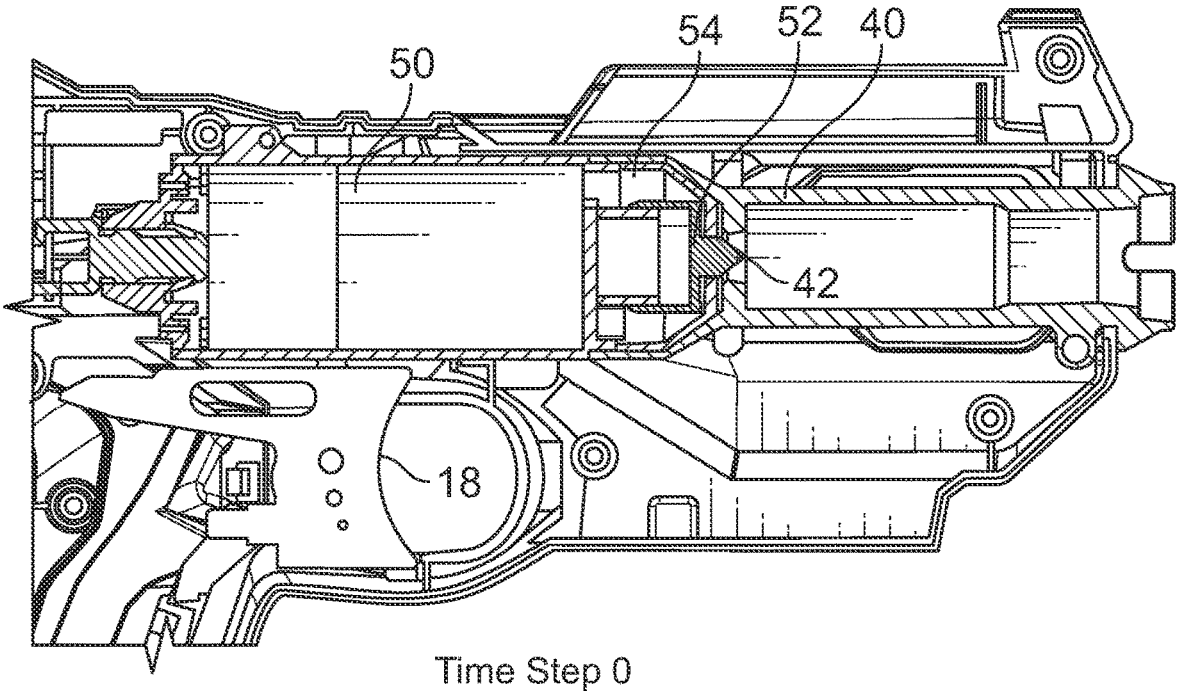

FIGS. 9A and 9B are exposed side elevational and perspective views, partially in section, of an alternate embodiment non-motorized toy projectile apparatus checking for an improvised projectile of the launch apparatus with an pneumatic air piston cylinder 50 shown at rest without an inserted projectile present in FIG. 9B and showing an improvised projectile safety valve seat 52 at an alternate projectile receiving opening 42 with corresponding step 40 with a small spring for keeping valve closed to close off air pathway to dart tube, with the contact valve contact component 54 provided as an alternate elongated structure facilitating the improvised projectile checking housing assembly to check the step structure 40 and projectile receiving opening 42. Herein as shown in FIG. 9B, the launcher is at rest at Time Step 0 where the piston is already primed and pulled back.

Figure 10:
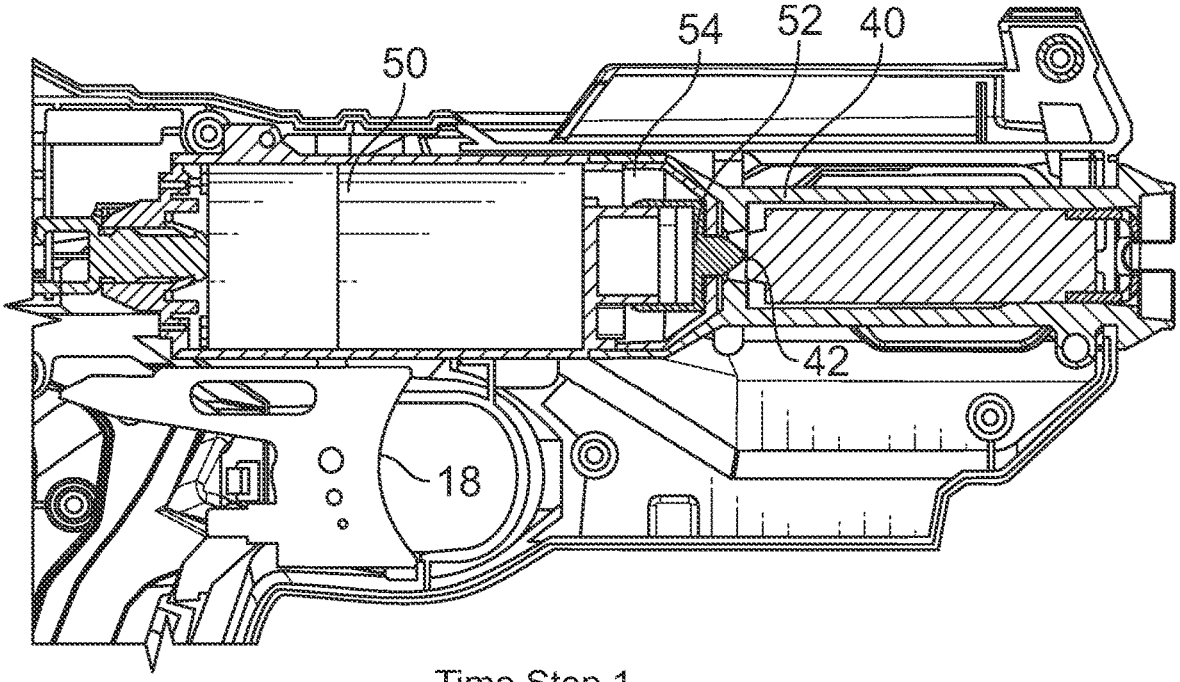
FIG. 10 is a side elevation view, partially in section, of the FIG. 9B air piston cylinder launch apparatus shown as about to check and appropriate size projectile present at the projectile receiving opening of the improvised projectile checking housing assembly.

FIG. 10 is a side elevation view of the air piston cylinder launch apparatus shown as about to check an appropriate size projectile present at the projectile receiving opening 42 of the improvised projectile checking housing assembly 20, with the launcher about to check Time Step 1 where the dart is beginning to be inserted into front load barrel. The tip of the dart is not yet aligned with the base of the cutout found on the barrel tip, at which time the dart starts to contact valve contact component 54 elongated structure for the improvised projectile checking.

Figure 11:
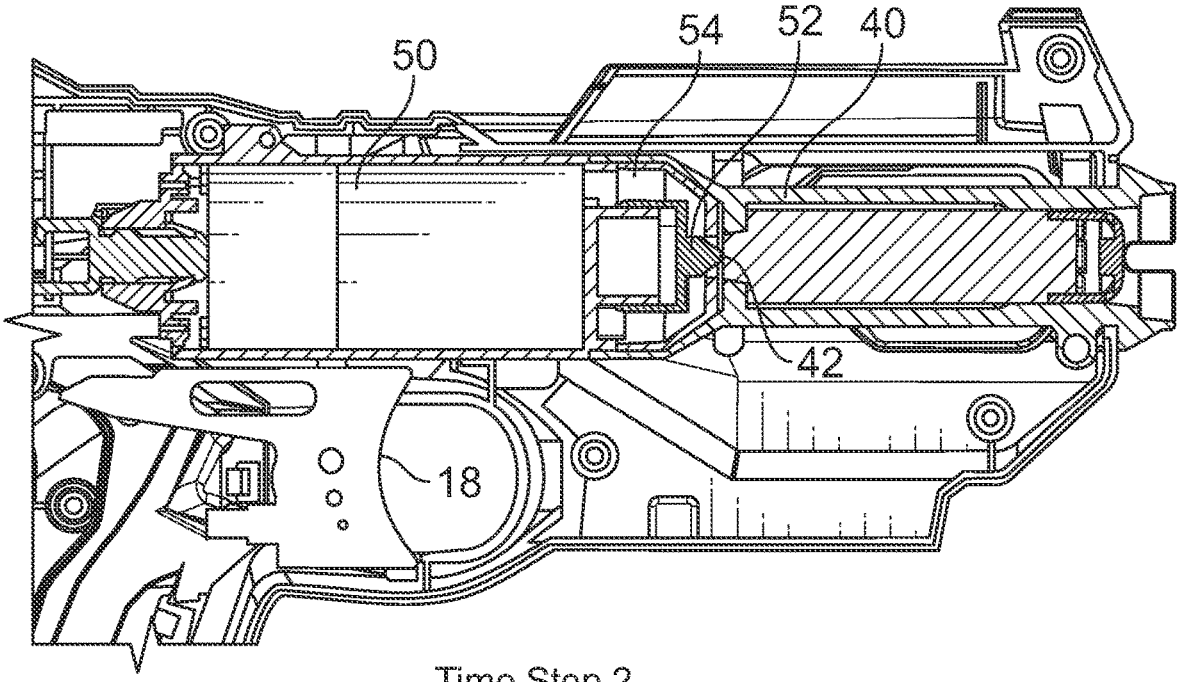
FIG. 11 is a side elevation view, partially in section, thereof where the pneumatic air piston cylinder launch apparatus is shown checking the appropriate size projectile present at the projectile receiving opening of the improvised projectile checking housing assembly.

FIG. 11 is a side elevation view, partially in section, thereof where the pneumatic air piston cylinder launch apparatus is shown checking the appropriate size projectile present at the projectile receiving opening 42 of the improvised projectile checking housing assembly 20, with the launcher checked and ready at Time Step 2 where the IP nub 35 is fully inserted into IP nub 35 receptacle found on dart barrel backstop. The valve is now fully open wherein that dart is fully inserted into barrel. The barrel cutout is aligned with tip of the dart, indicating pushing further is not required.

Figure 12:
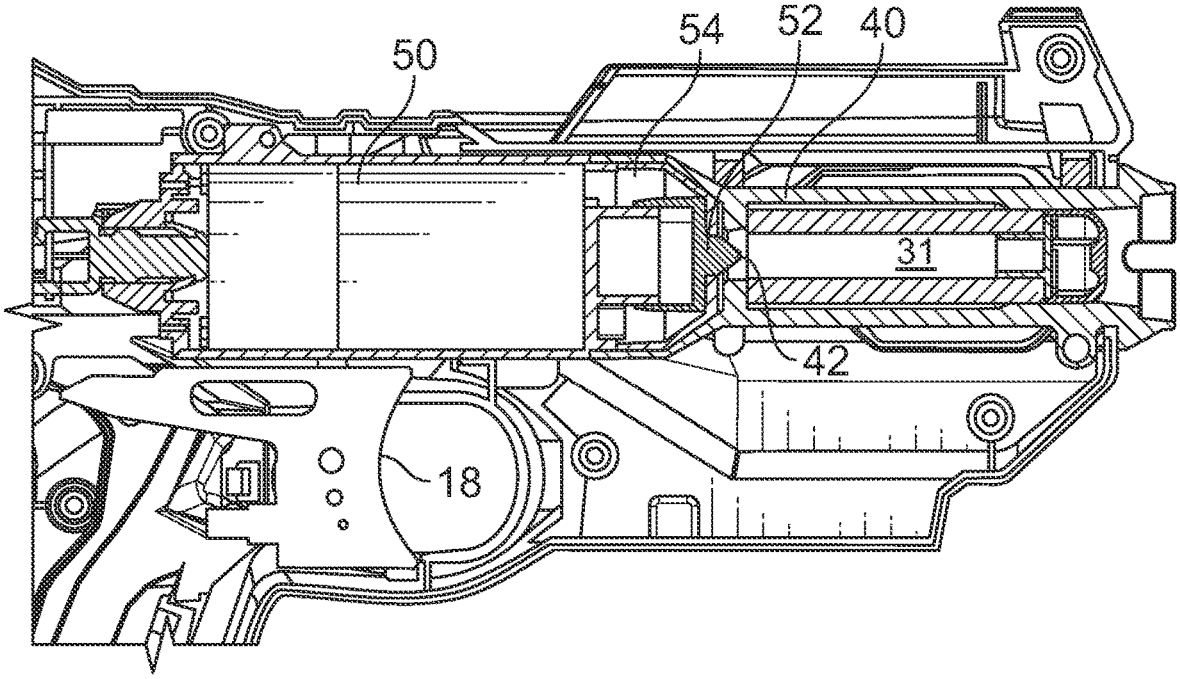
FIG. 12 is a side elevation view, partially in section, thereof where the pneumatic air piston cylinder launch apparatus shown as preventing insertion, loading of inappropriate objects, or a non-authorized tubular projectile with a hollow central core thus further preventing operation of the launch apparatus based on the checked opening of the improvised projectile checking housing assembly.

FIG. 12 is a side elevation view, partially in section, thereof where the pneumatic air piston cylinder launch apparatus shown as preventing insertion, loading of inappropriate objects, or a non-authorized tubular projectile with a hollow central core. The improperly structured dart or non-authorized tubular projectiles prevents further operation of the launch apparatus based on the checked opening 42 of the improvised projectile checking housing assembly 20 based on such a dart fully inserted and seated on dart barrel backstop because there is no structure to push against valve contact 54, thus keeping valve seat 52 still completely closed, and even if dart had solid foam body, valve would stay closed.

In the forgoing, the above described embodiments disclosed front loaded toy projectile launchers include motorized and non-motorized toy projectile apparatus embodiments providing checking for improvised projectile at the launch apparatus with motor driven projectile propelling flywheels as well as alternate pneumatic air piston cylinder embodiments having IP detection systems. As detailed herein so long as the nub portion 35 has an effective diameter with features such as a rearward nub portion 35 to fit within and engage with launch apparatus 10 operation using improvised projectile checking housing assembly 20 for correspondingly structured and appropriately sized projectiles. Such features include requiring the corresponding stepped end 33 and nub portion 35 present at a projectile receiving opening 42 locking or other interfacing structure of an IP detection system.

Various toy projectile launchers can be used with the systems herein having a stepped and nub portion 35 and a toy projectile launch apparatus having a projectile receiving opening and improvised projectile checking housing assembly that can identify the toy projectile as compatible for the launchers. Details of the checking operation are discussed below for an embodiment of the system and illustrated in time steps, identifying the time step status in checking and non-checking positions, i.e. detection of the nub portion 35 as beginning initial removal of system slack discussed below.

As discussed below, a rear loaded launcher having such IP detection system is described. Likewise in the absence of an appropriately dimensioned numb structure on projectile, there is no structure to unlock as trigger 18, 118 advances thereby preventing engagement. In embodiments, a toy projectile launcher having an IP detection system may identify a step between a second end of the projectile and the nub portion. The step can be defined by a difference in diameter between at the second end or fin end and the nub portion. In embodiments, the difference between the diameter at the second end or fin end and the diameter of the nub can be about 0.5 mm to about 3 mm, about 1 mm to about 2 mm, about 1 mm to about 3 mm, or about 0.7 mm to about 1.6 mm.

Figure 13:
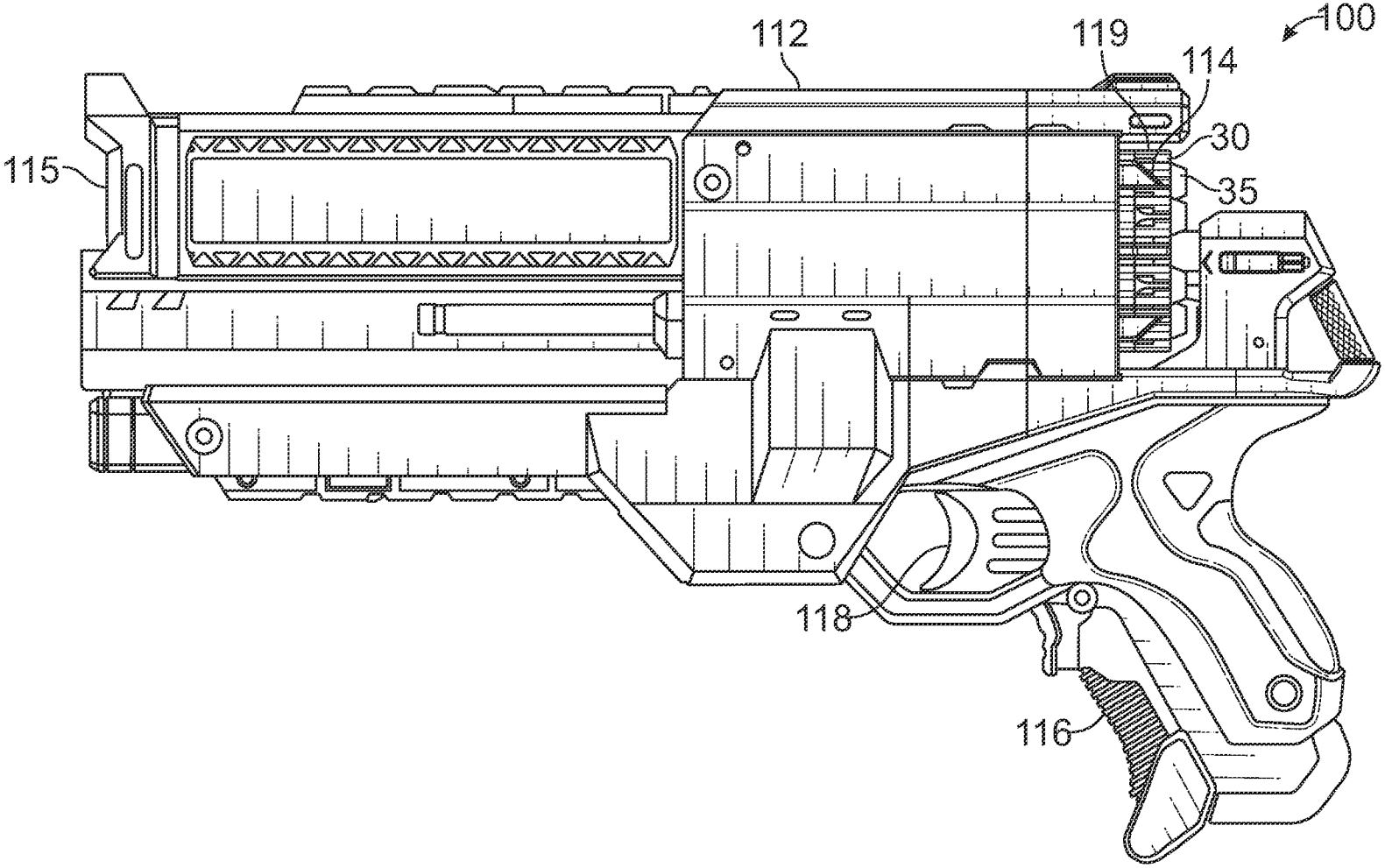
FIG. 13 is a perspective view of a toy launch apparatus rearward darts.
Figure 14:
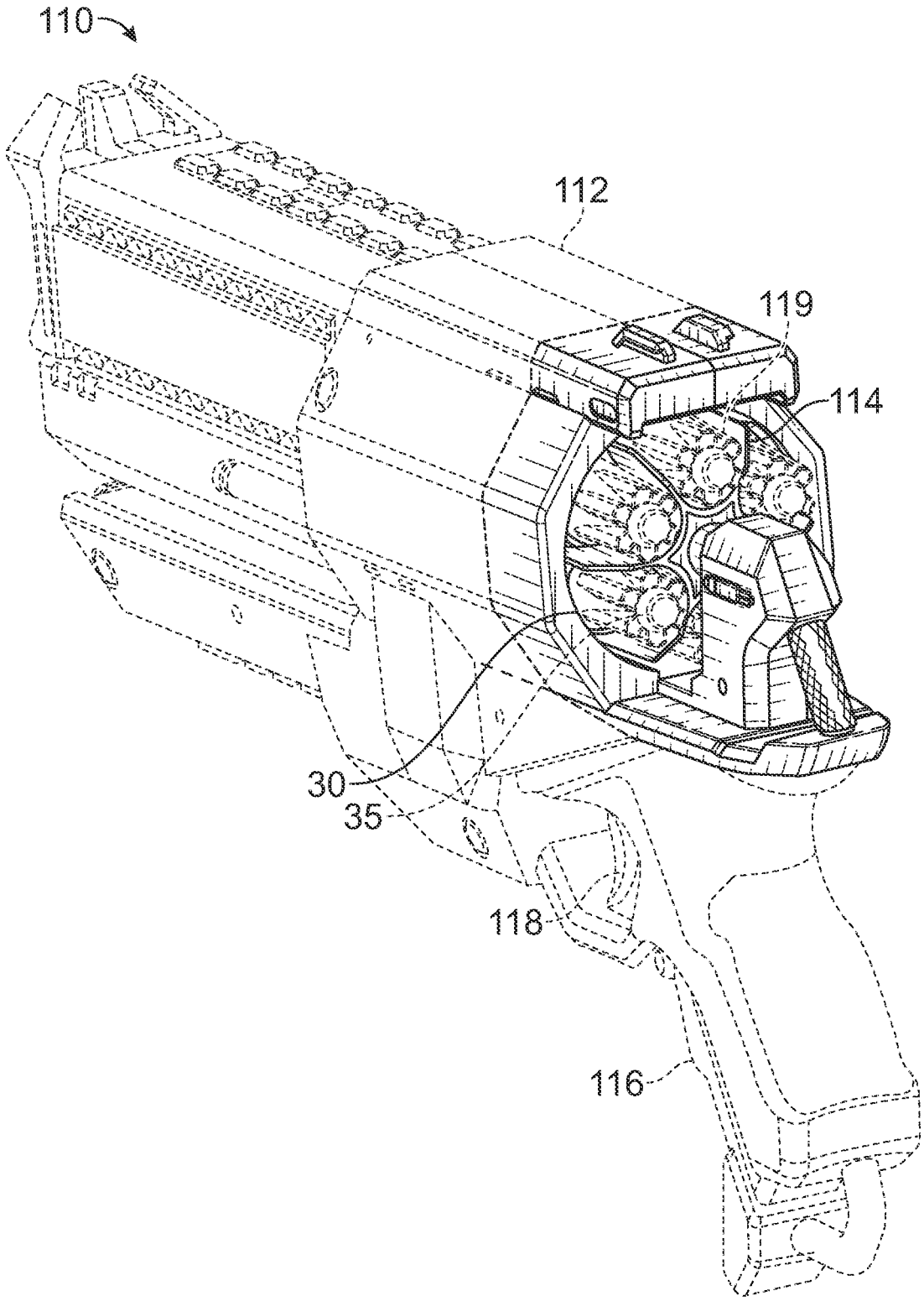
FIG. 14 shows a side elevational view of the launch apparatus showing launch apparatus rearward pusher engagement embodiment of the invention is shown in launch apparatus.

FIG. 13 is a perspective view of a toy launch apparatus embodiment rearward pusher engagement to advance darts, with FIG. 14 showing the side elevational view of the launch apparatus.

Figure 15:
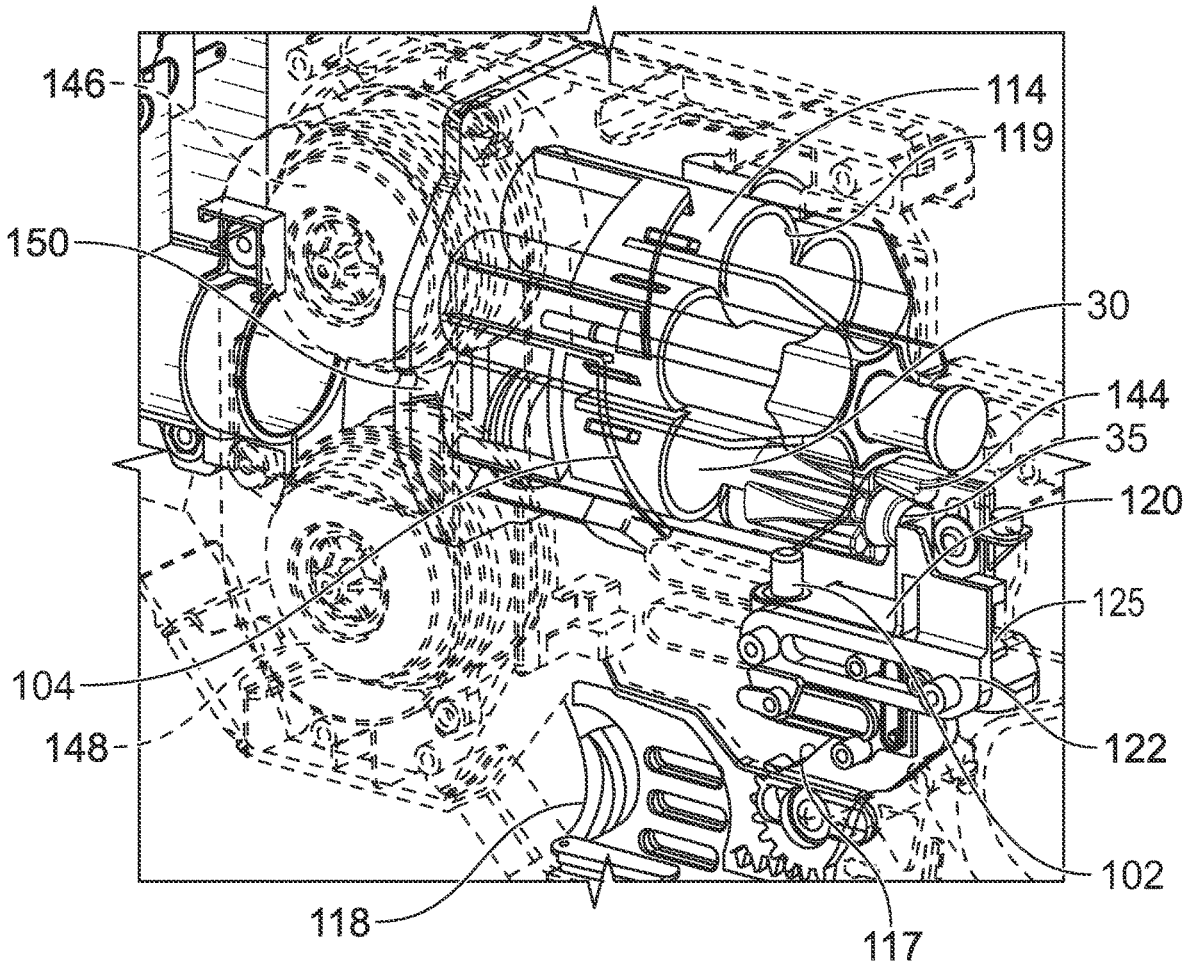
FIGS. 15 and 16 are exposed side perspective and side elevational views of the toy projectile apparatus with multiple improvised projectile features to be checked for the launch apparatus with single projectile loaded into rotating barrel dart chamber.
Figure 16:
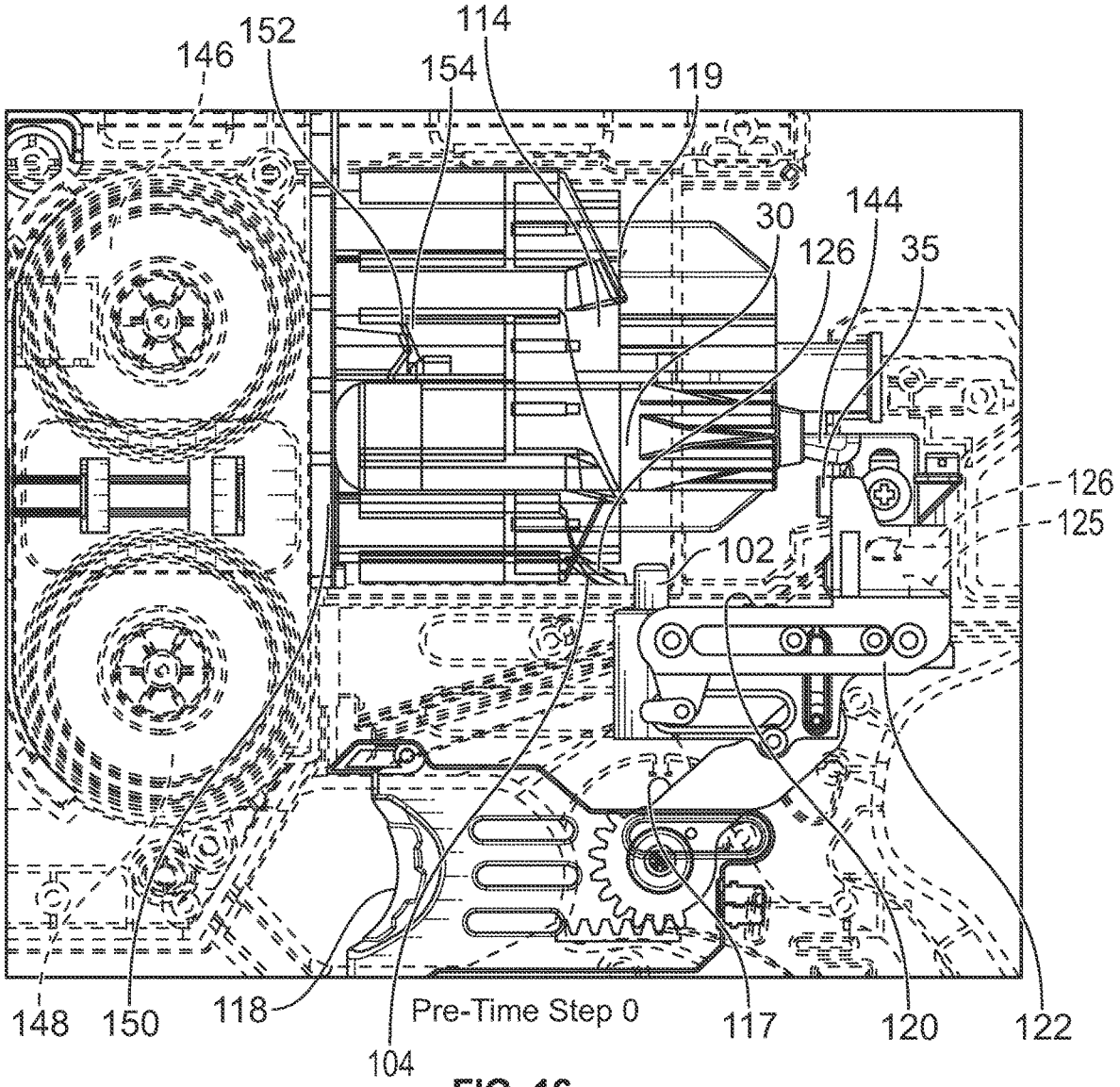

FIGS. 15 and 16 are exposed side perspective and side elevational views of the toy projectile apparatus with multiple improvised projectile features to be checked for the launch apparatus having a housing partially removed to reveal internal structures showing the rearward loading and pusher engagement to advance dart projectiles checking and locking features embodied with a rearward embodiment checking housing assembly in accordance with the present inventions.

Referring now to FIGS. 13 through 15, and particularly 16 the shown toy launch apparatus rearward pusher engagement embodiment of the invention is shown in launch apparatus 110 having a housing assembly 112 including a barrel portion 114 with chambers 119, a muzzle portion 115, a grip portion 116 and a trigger 118. FIG. 16 is shown in a pre-time step 0 with the launch apparatus 110 at rest, having no pressure on the trigger 118.

As shown in FIGS. 15 and 16 with single projectile 30 loaded into rotating barrel projectile retaining element 114 at dart chamber 119. As discussed above in connection with projectile reference nos. 30, 32, 34, 36, 38 and FIGS. 2C through 2F, the projectile 30 has predetermined dimensions and safety features, including its rearward nub portion 35 likewise preventing launch apparatus 110 operation where other objects may be inserted at dart chamber 119. If projectile 30 is inserted too far, friction of dart tip with the dart backstop 150 could bind the drum 114 structure, and to realign gear teeth 152 are provided and here fully engaged with gear teeth 154 with a peak to valley engagement. At pre-time step 0, with reference to FIG. 16 with the apparatus 110 at rest and no pressure on the trigger 118, an improvised projectile (IP) checking lock gauge 144 rides atop of a follower housing 120 which advances a follower 102 for rotating the projectile retaining element 114 to its next dart chamber 119, while the follower housing 120 also keeps the IP lock gauge 144 locked in the up position so the follower 102 can de-couple and still advance the dart drum projectile retaining element 114, even when no darts are present. Presently follower 102 is not in contact with the dart drum ramps 104 as yet for advancing drum 114. Steps discussed in detail below during full trigger 118 pull will fire the dart projectile 30 provided its having the predetermined dimensions and features discussed, with multiple improvised projectile checking by the rear loaded launcher 110 employing its IP detection system.

As shown the projectile retaining element or drum 114 has a front side and a backside on the toy launch apparatus for receiving projectiles 30, 32, 34, 36, 38 at the backside thereof. In FIGS. 15 and 16 projectile propelling rotating flywheels 146, 148 as a motor driven projectile propelling mechanism is forward the projectile retaining element 114 for propelling the received projectile 30. The IP lock gauge 144 is supported within the apparatus 110 rearward the dart chamber 119 and drum 114 with IP lock gauge 144 disposed to translate alongside the projectile 30 received at the backside of the drum 114 for checking the outer diameter of the nub portion 35 of received projectile 30. The follower housing 120 is configured to reciprocate adjacent and rearward the backside of the drum 114 and towards the front side thereof, with the follower housing including cam surfaces 125, 126 to translate the IP lock gauge 144. The cam surfaces 125, 126 are seen further as cam surfaces 125 providing an Unlock Pathway there-through in the case of correct dart alignment, while the backside of cam surfaces 126 provides a catch thereat for locking abutment in the case of incorrect dart gauge misalignment for locking the misaligned cam surfaces 125, 126 with one another to prevent launch of an inappropriate object or a non-authorized projectile therefrom, as discussed herein and in FIGS. 19C and 22B showing close up views of lock engaged and disengaged conditions of the pathway as between cam surfaces 125, 126. Accordingly at least one latch is positioned to lock in relation to the catch backside of cam surfaces 126 of the IP lock gauge 144 with the IP lock gauge 144 improperly translated in the absence of a verified projectile preventing the pathway so as to prevent advancing of the projectile 30 forward.

A linkage 117 is provided operable with the trigger 118 of the apparatus 110 for moving the follower housing 120. A pusher 122 is coupled to the follower housing 120 for advancing the received projectile 30. The cam surfaces 125 pathway is cooperatively positioned as discussed at the pusher 122 in relation to the catch backside of cam surface 126 with the IP lock gauge 144 having translated alongside the projectile 30. To confirm the outer diameter of an authorized and verified projectile 30, cam surfaces 125 allow the discussed Unlock Pathway through which cam surface 126 passes in the case of correct alignment, allowing the pathway of the pusher 122 to pass the catch of cam surface 126 of the IP lock gauge 144 thus advancing the projectile 30 forward in the dart chamber 119 of drum 114. The described IP lock gauge 144 is able to unlock or unlock the pusher 122 respectively based on alignment or misalignment thereof.

Figure 17A:
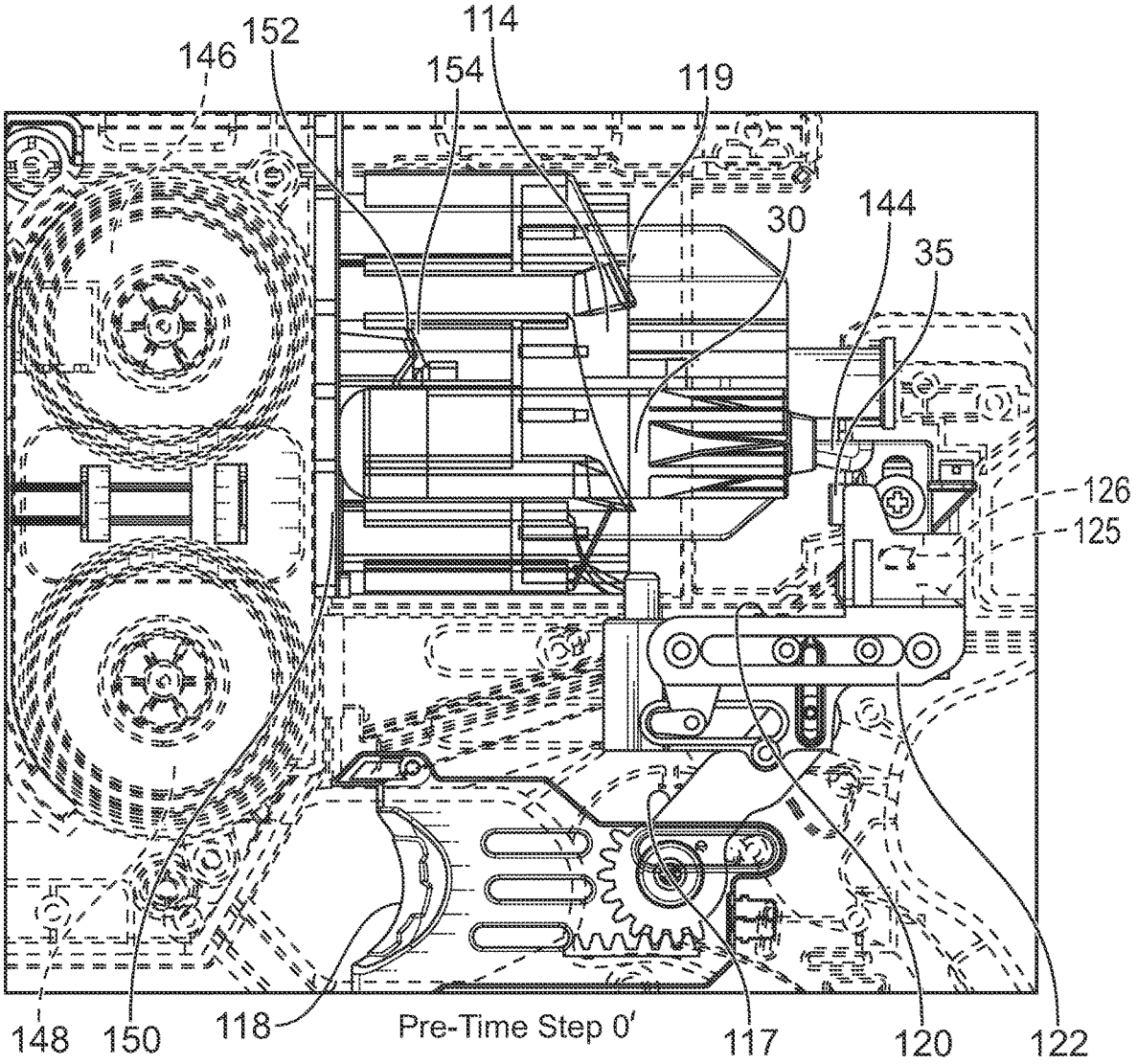
FIGS. 17A and 17B illustrate where the apparatus has slight pressure on the trigger and a projectile in the next chamber to be fired, for realigning the dart tip with respect to the dart backstop as the drum structure translates while initiating advancing of the drum.
Figure 17B:
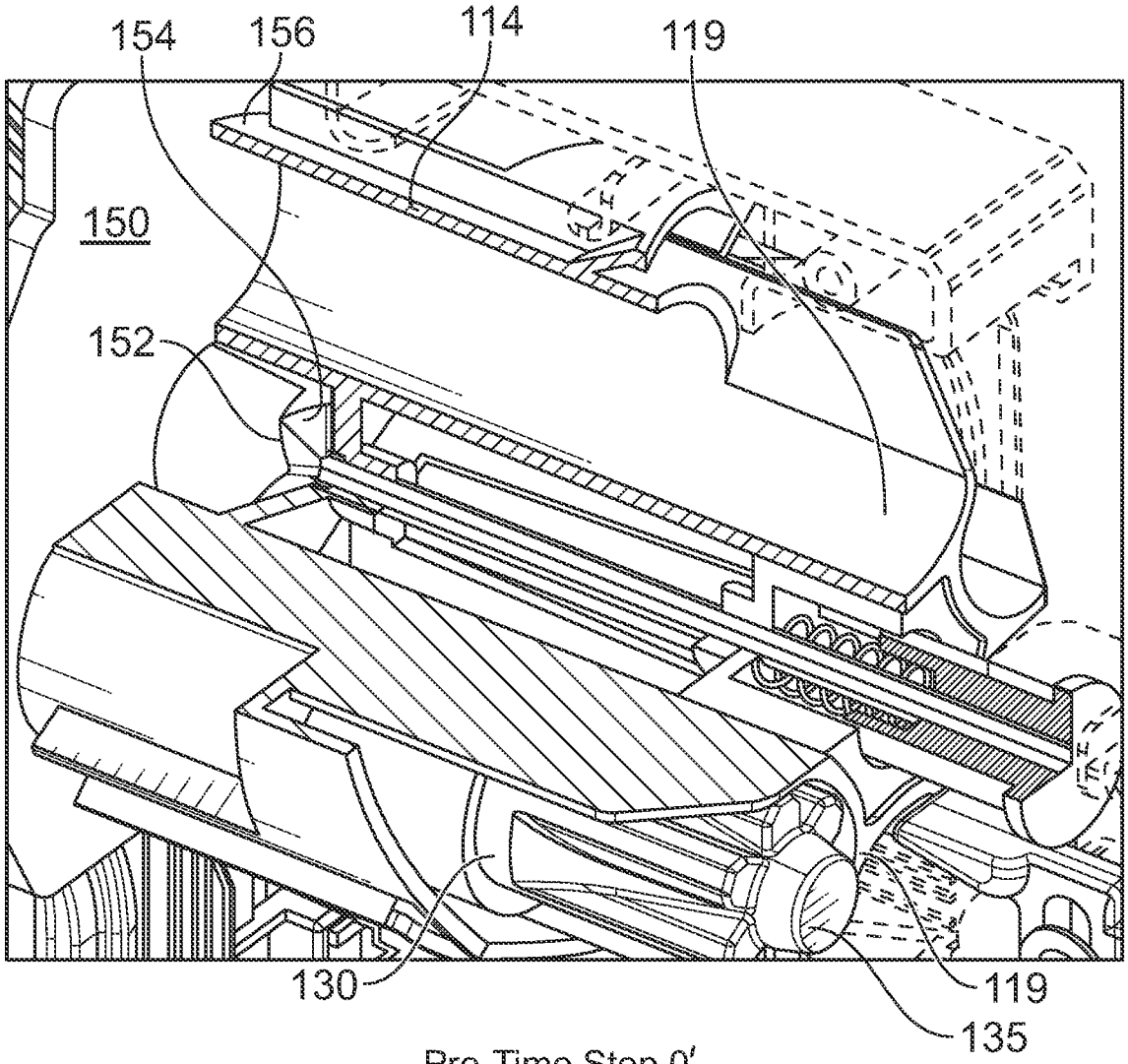

Referring now to FIGS. 17A and 17B, the apparatus 110 is shown in a pre-time step 0' with slight pressure on the trigger 118. The projectile 30 is in the next chamber to be fired. The gear teeth 152 are engaged with gear teeth 154 found inside dart drum 114. The gear teeth 152 are engaged with gear teeth 154 with a peak to valley engagement for drum 114 and projectile 30 realignment should an individual projectile be inserted too far, for realigning the dart tip with respect to the dart backstop 150 as the drum 114 structure translates. The follower 102 is now in contact with the dart drum ramps 104 initiating advancing drum 114.

Figure 18A:
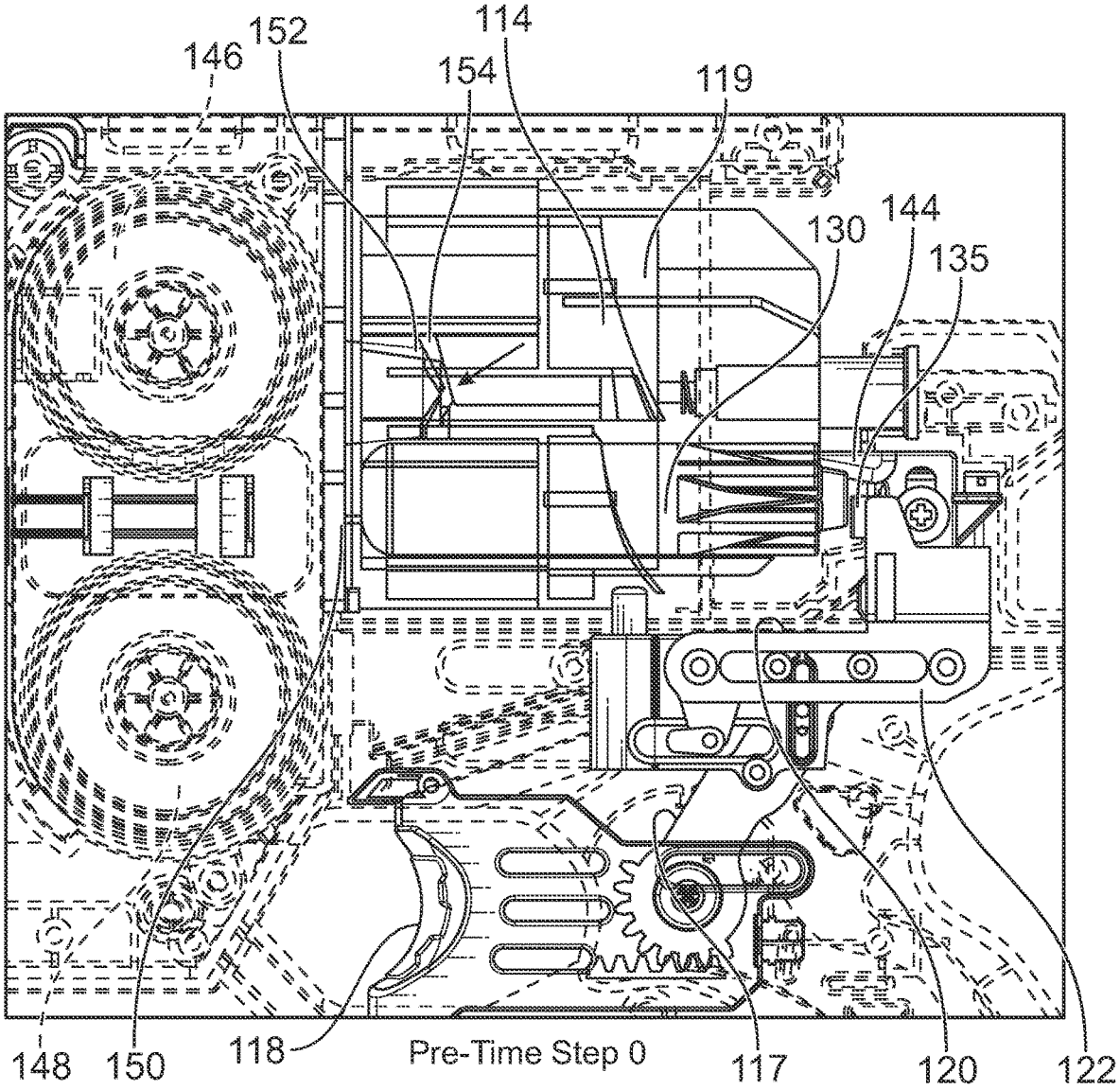
FIGS. 18A and 18B illustrate initiation of a dart depth check for the next chamber to be fired with the projectile portion in the correct location for sensing.
Figure 18B:
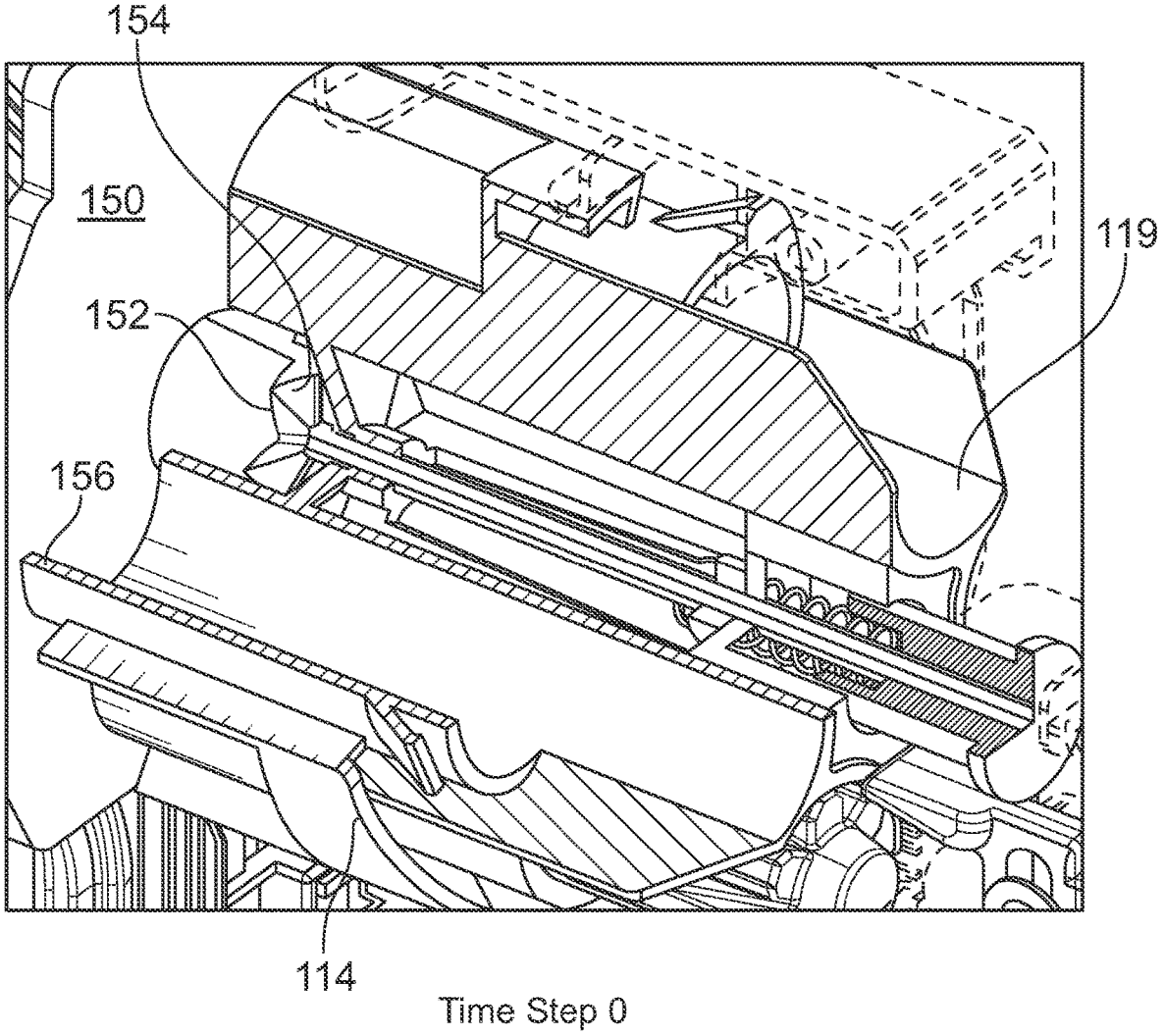

Referring now to FIGS. 18A and 18B, the apparatus 110 is shown in time step 0 for a Dart Depth Check, follower 102 in contact with the dart drum ramps 104 advanced drum 114 such that the element 144 has translated up and atop the projectile 30 nub portion 35 wherein the projectile 30 is in the next chamber to be fired and is now midway to getting behind the pusher 122. It will be noted that gear teeth 152 are disengaged with gear teeth 154 found inside dart drum 114 as valley to valley, not valley to peak as between gear teeth 152 and gear teeth 154 therein. At this point dart drum 114 at 156 has backed away from the dart backstop 150. Where projectile 30 may have been over inserted with dart tips expanded, tips can now rebound. With tips under no compression from over insertion the dart drum 114 returns to being closer to the dart backstop 150. Now tips hit backstop ensuring projectile 30 nub portion 35 is in the correct location for sensing.

Figure 19A:
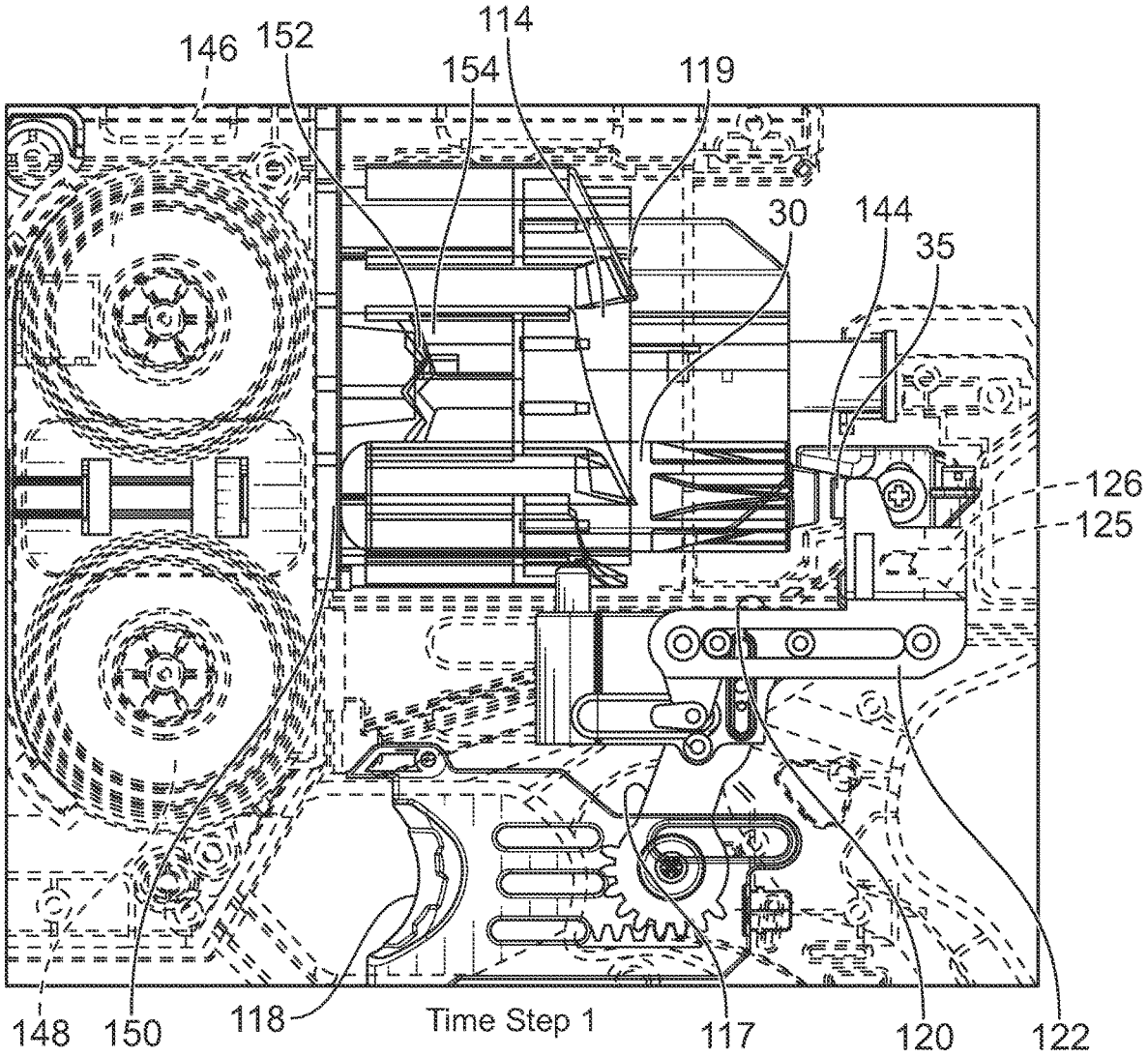
FIGS. 19A, 19B and 19C illustrate where the apparatus is about to check projectiles with slight pressure on the trigger to remove slack and have IP lock gauge in contact with the projectile portion touching the outer diameter (OD) on the back thereof.
Figure 19B:
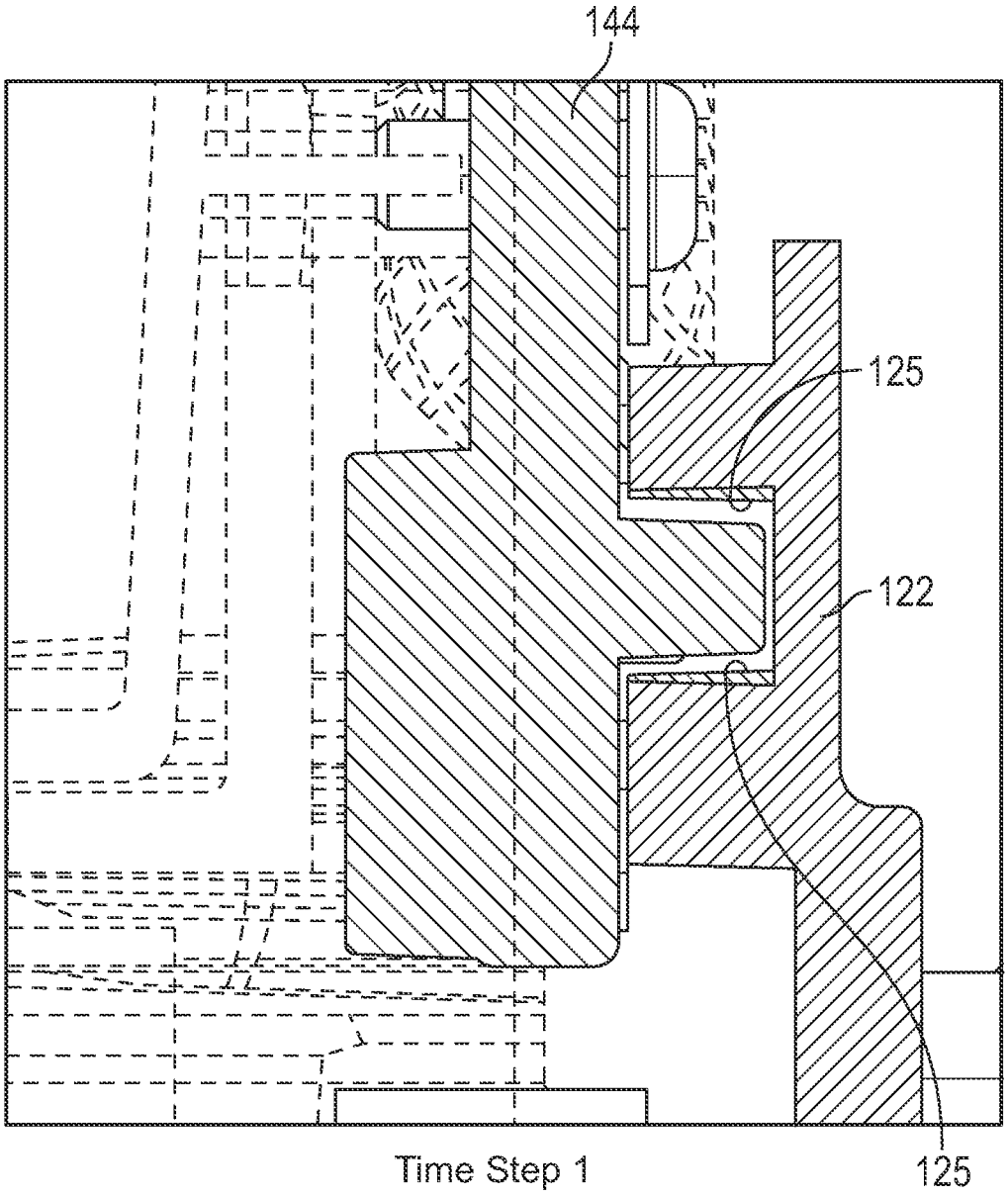
Figure 19C:
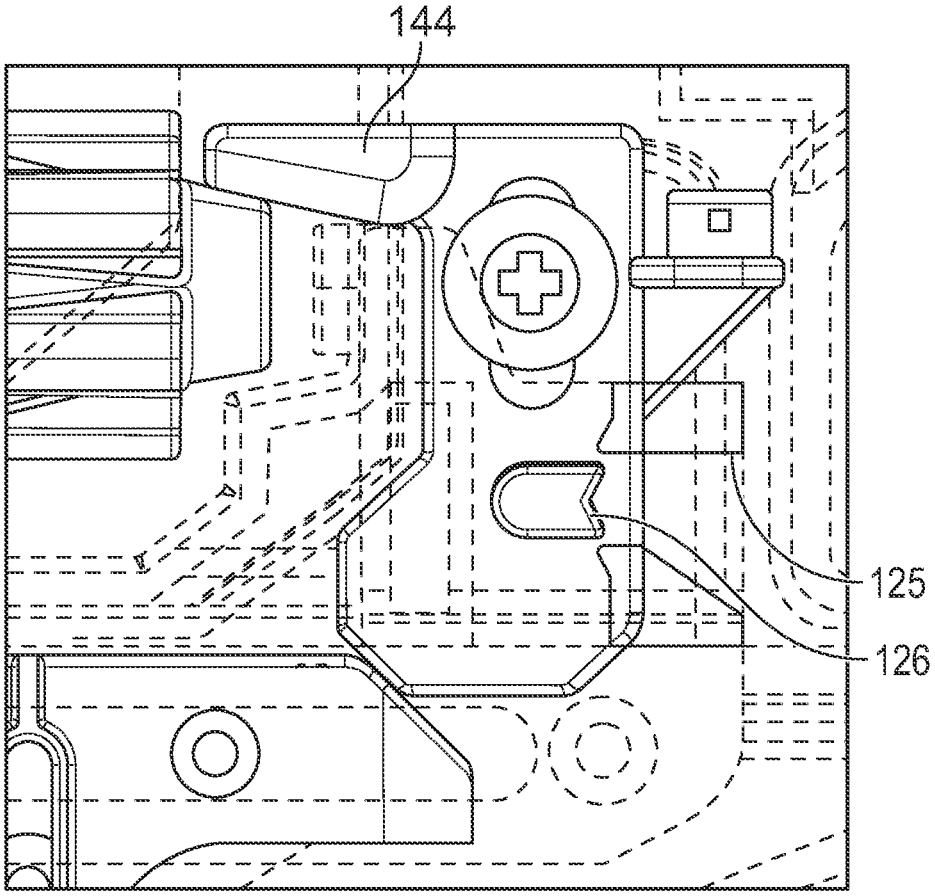

Referring now to FIGS. 19A, 19B and 19C, the apparatus 110 is shown in time step 1 as About to Check with slight pressure on the trigger to remove slack and have IP lock gauge 144 in contact with projectile 30 nub portion 35, as the dart lines up with the firing location. The projectile 30 nub portion 35 has no pressure on it yet, while IP detector Dart Depth Check is performed with the IP lock gauge 144 touching the outer diameter (OD) of the nub portion 35 on the back of the projectile 30. IP detector IP lock gauge 144 is lined up with the unlock pathway 125 on the pusher 122 but has not yet moved.

Figure 20A:
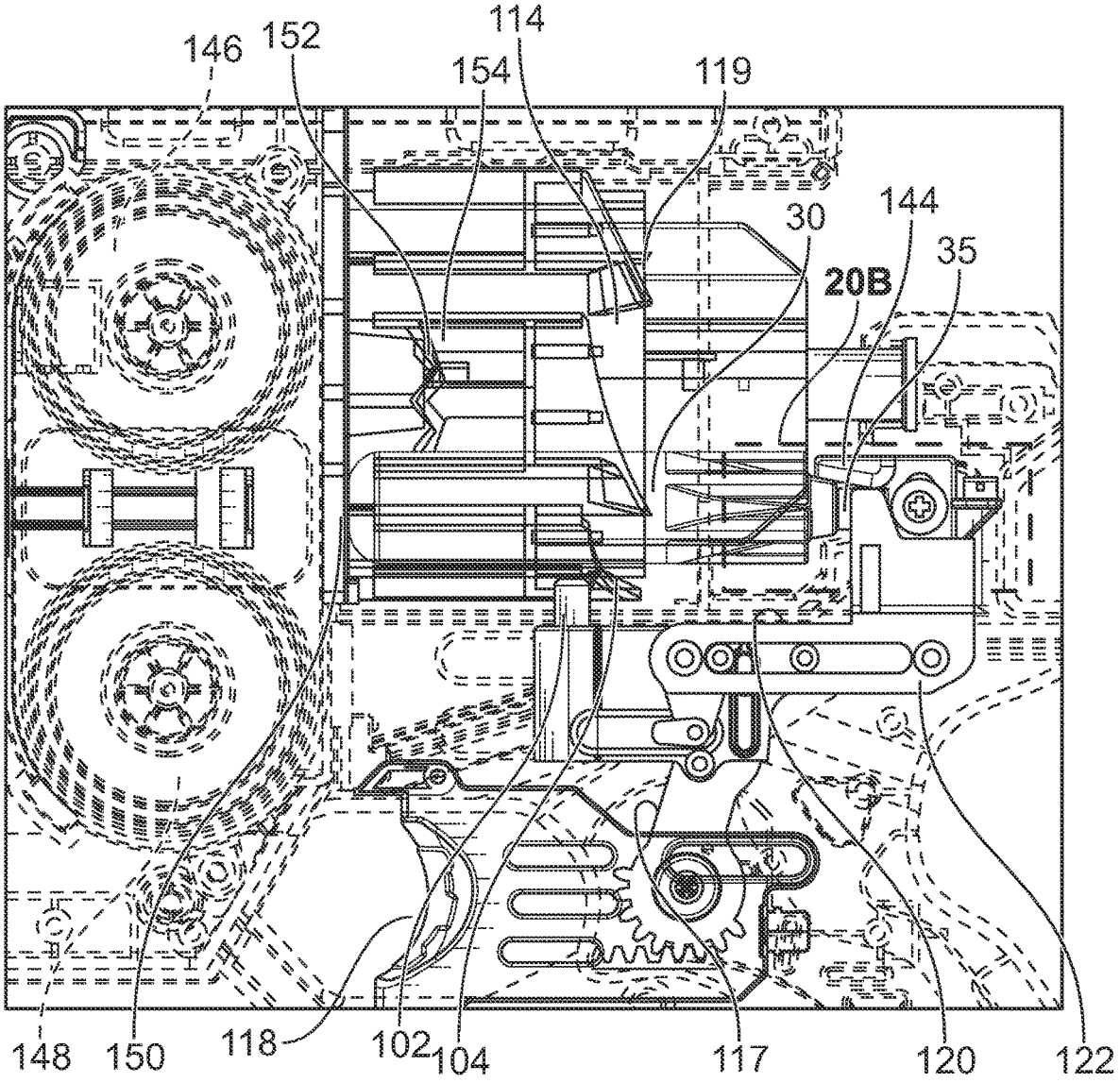
FIGS. 20A and 20B illustrate the apparatus engaged, checked and pushing with slight pressure on the projectile.
Figure 20B:
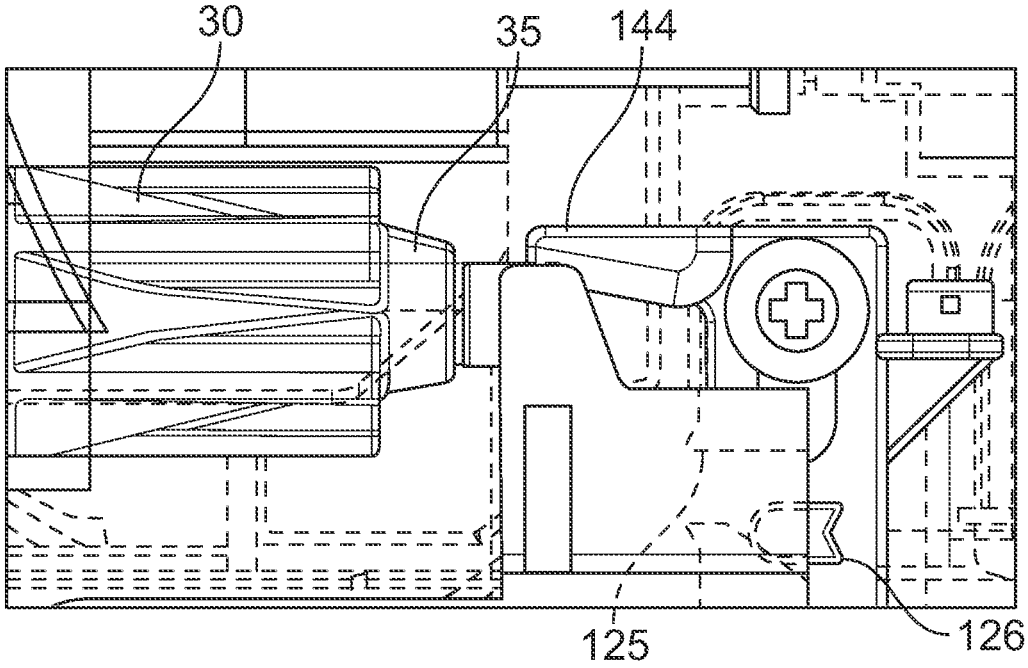

Referring now to FIGS. 20A and 20B, the apparatus 110 is shown in time step 2 for Checked and Pushing with slight pressure on the projectile 30. The IP detector IP lock gauge 144 has entered the unlock pathway 125 and is now clear to allow pusher 122 to advance, while having IP detector IP lock gauge 144 ride the pusher 122 so as to reset after the projectile 30 has been launched. As such the IP lock gauge 144 will continue to fall past where it was when it checked for the nub portion 35. Below the IP lock gauge 144 contact face that was touching the nub 35 is now below the location it was during the dart check.

Figure 21:
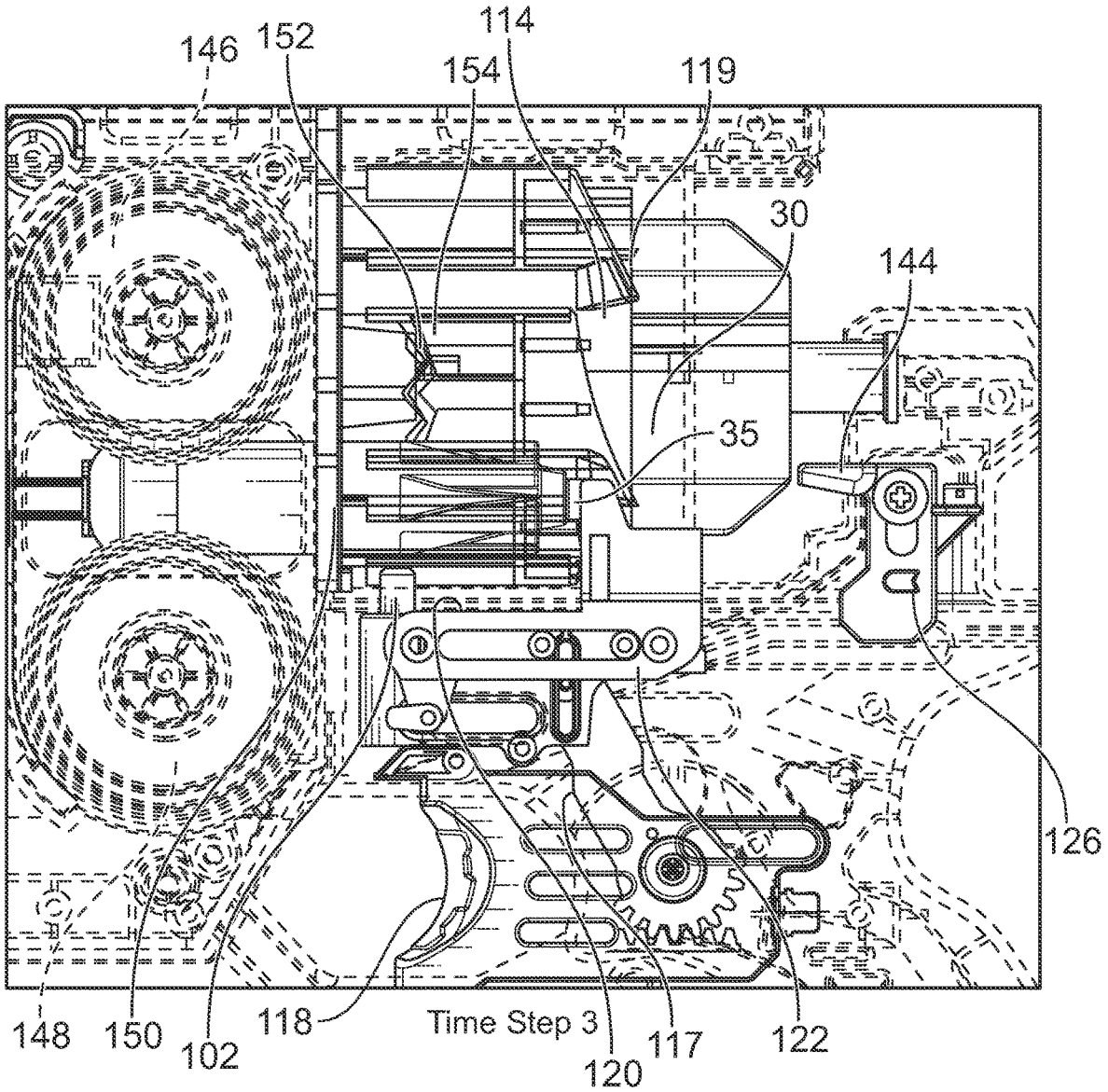
FIG. 21 illustrates the apparatus advancing the projectile into flywheels with full pressure on the trigger to advance the projectile.

Referring now to FIG. 21, the apparatus 110 is shown in time step 3 for advancing the projectile 30 into flywheels 146, 148 with full pressure on the trigger to push dart into flywheels 146, 148. It will be appreciated that IP detector IP lock gauge 144 is at its lowest state waiting to ride up follower housing 120 when trigger returns. When trigger 118 pressure is removed, apparatus will rest to pre-Time step 0.

Figure 22A:
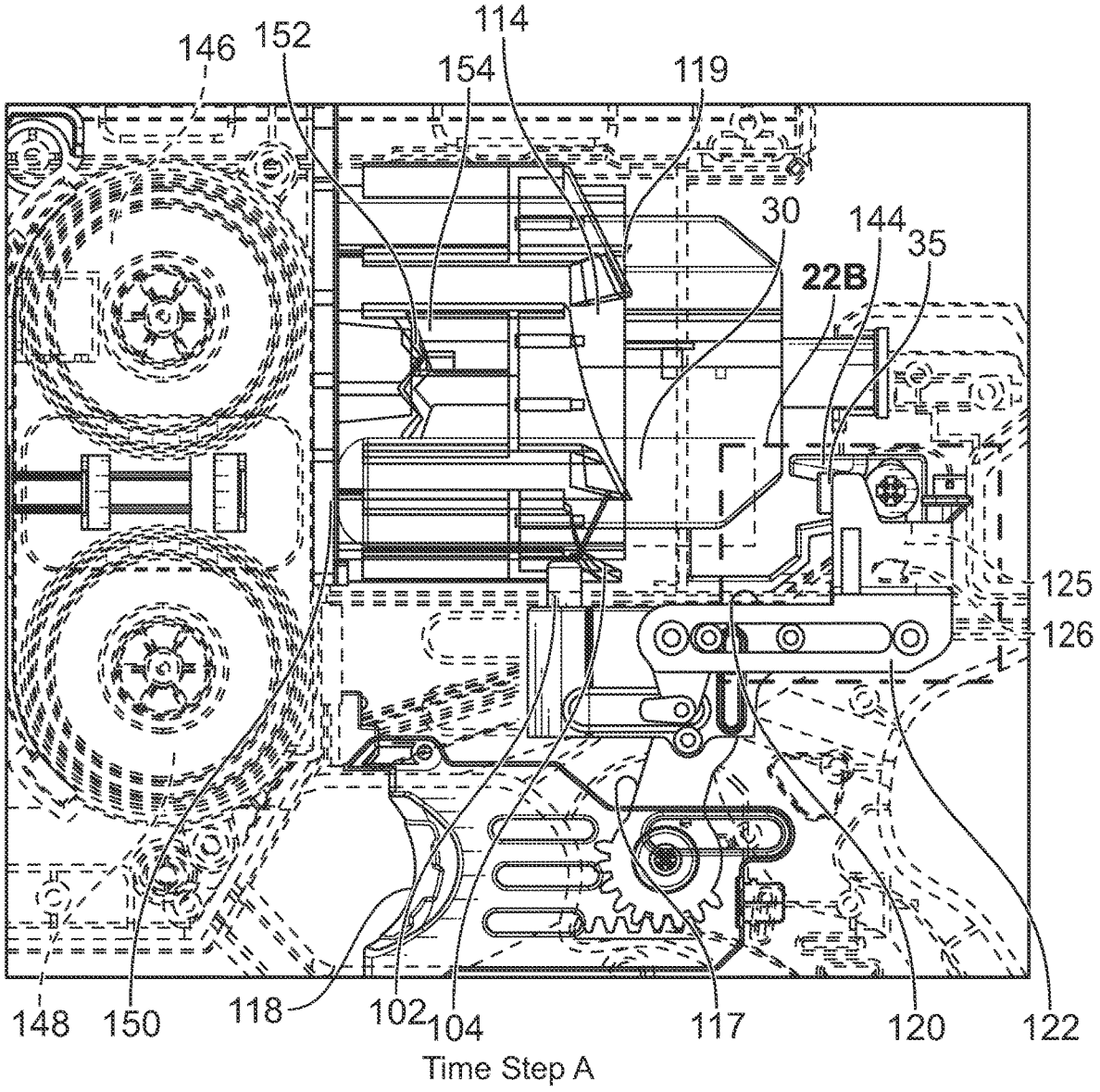
FIGS. 22A and 22B illustrate where the apparatus following its IP lock gauge being improperly translated in the absence of a verified projectile catching and locking the pathway so as to prevent advancing of the projectile.
Figure 22B:
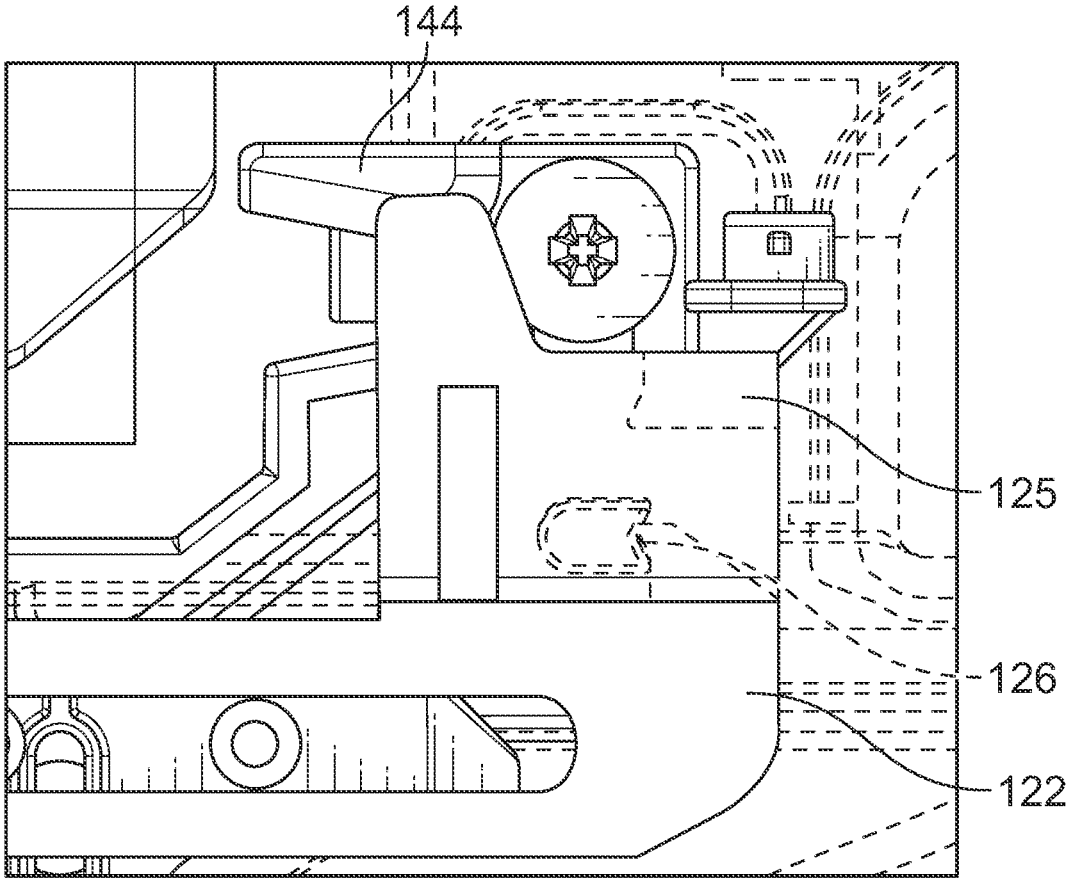

Referring now to FIGS. 22A and 22B, the apparatus 110 is shown as Time Step A inasmuch as the apparatus cannot proceed to a later step following the IP lock gauge 144 being improperly translated in the absence of a verified projectile, catching and locking the pathway so as to prevent advancing of the projectile 30 in view of catch at the gauge preventing advancing at FIG. 22B. With cam surfaces 125, 126 locked with full pressure on the trigger 118, the follower 102 is nonetheless de-coupled and may still advance the dart drum projectile retaining element 114 without launching any objects, despite loading of inappropriate objects, or a non-authorized dart which does not have IP bump being without nub portion 35. IP lock gauge 144 is thus able to lock pusher 122 due to IP lock gauge 144 at the catch of the cam 126 with the pusher 122 latch.

The toy launch apparatus and methods with multiple improvised projectile checking and locking features, further include the appropriate size projectile positioned at the projectile barrel assembly adjacent the projectile receiving opening at the improvised projectile checking housing assembly thereof; and the improvised projectile checking housing assembly allows the appropriate size projectile with the corresponding step present at the projectile receiving opening of the improvised projectile checking housing assembly and preventing another projectile from the projectile receiving opening. A projectile retaining element having a front side and a backside on the toy launch apparatus for receiving projectiles therein at the backside of the projectile retaining element; a projectile propelling mechanism forward the projectile retaining element for propelling the received projectiles from the front side of the projectile retaining element; an improvised projectile checking lock gauge supported with the toy launch apparatus rearward the projectile retaining element where the gauge is disposed to translate alongside the projectiles received at the backside of the projectile retaining element for checking the outer diameter of received projectiles; a follower housing configured to reciprocate adjacent and rearward the backside of the projectile retaining element and towards the front side thereof; a linkage in the toy launch apparatus for moving the follower housing; a pusher coupled to the follower housing for advancing projectiles received at the backside of the projectile retaining element; and a catch at the gauge preventing advancing of the projectile forward in the projectile retaining element.

The pathway at the pusher cooperatively positioned in relation to the catch at the gauge where the gauge having translated alongside the projectile to confirm the outer diameter of a verified projectile allows the pathway of the pusher to pass the catch of the gauge and advance the projectile forward in the projectile retaining element; and at least one latch at the pusher positioned to lock in relation to the catch of the gauge with the gauge improperly translated rearward the projectile retaining element in the absence of a verified projectile preventing the pathway of the pusher to pass the catch of the gauge and preventing advancing of the projectile forward in the projectile retaining element.

The cam surface translates the gauge with the follower housing configured to reciprocate with the linkage moving the follower housing where the catch at the gauge locks the pusher in relation to alignment having the pathway at the pusher cooperatively positioned in relation to the catch at the gauge with the gauge having translated. A cam surface to translate the gauge with the follower housing configured to reciprocate with the linkage moving the follower housing; a pathway at the pusher cooperatively positioned in relation to the catch at the gauge where the gauge having translated alongside the projectile to confirm the outer diameter of a verified projectile allows the pathway of the pusher to pass the catch of the gauge and advance the projectile forward in the projectile retaining element; and at least one latch at the pusher positioned to lock in relation to the catch of the gauge with the gauge improperly translated rearward the projectile retaining element in the absence of a verified projectile preventing the pathway of the pusher to pass the catch of the gauge and preventing advancing of the projectile forward in the projectile retaining element.

It is noted that throughout this disclosure, words such as "forward", "rearward", "upper", "lower", "top", "bottom", "front", "rear", "above" and "below", as well as like terms, refer to portions of the toy launch apparatus 10 as they are viewed in the drawings relative to other portions or in relationship to the positions of the apparatus as it will typically be held and moved during play when operated by a user.

From the foregoing, it can be seen that there has been provided features for an improved toy launch apparatus and a disclosure of the method for making the toy. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launch apparatus with multiple improvised projectile checking and locking features, comprising:

a projectile retaining element having a front side and a backside on the toy launch apparatus for receiving projectiles therein at the backside of the projectile retaining element;

a projectile propelling mechanism forward the projectile retaining element for propelling the received projectiles from the front side of the projectile retaining element;

an improvised projectile checking lock gauge supported with the toy launch apparatus rearward the projectile retaining element where said gauge is disposed to translate alongside the projectiles received at the backside of the projectile retaining element for checking the outer diameter of received projectiles; and a catch at said gauge preventing advancing of the projectile forward in the projectile retaining element.

2. The toy launch apparatus of claim 1, comprising:

a follower housing configured to reciprocate adjacent and rearward the backside of the projectile retaining element and towards the front side thereof; and a pusher coupled to the follower housing for advancing projectiles received at the backside of the projectile retaining element.

3. The toy launch apparatus of claim 2, comprising:

a pathway at the pusher cooperatively positioned in relation to the catch at said gauge where said gauge having translated alongside the projectile to confirm the outer diameter of a verified projectile allows the pathway of the pusher to pass the catch of said gauge and advance the projectile forward in the projectile retaining element; and at least one latch at the pusher positioned to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

4. The toy launch apparatus of claim 3, comprising:

a linkage in the toy launch apparatus for moving the follower housing.

5. The toy launch apparatus of claim 4, comprising:

a cam surface to translate said gauge with said follower housing configured to reciprocate with the linkage moving the follower housing where the catch at said gauge locks the pusher in relation to alignment having the pathway at the pusher cooperatively positioned in relation to the catch at said gauge with said gauge having translated.

6. The toy launch apparatus of claim 4, comprising:

a cam surface to translate said gauge with said follower housing configured to reciprocate with the linkage moving the follower housing;

a pathway at the pusher cooperatively positioned in relation to the catch at said gauge where said gauge having translated alongside the projectile to confirm the outer diameter of the verified projectile allows the pathway of the pusher to pass the catch of said gauge and advance the projectile forward in the projectile retaining element; and at least one latch at the pusher positioned to lock in relation to the catch of said gauge with said gauge improperly translated rearward the projectile retaining element in the absence of the verified projectile preventing the pathway of the pusher to pass the catch of said gauge and preventing advancing of the projectile forward in the projectile retaining element.

7. The toy launch apparatus of claim 3, wherein:
the verified projectile comprises a rearward step structure.

8. The toy launch apparatus of claim 7, wherein:
the verified projectile is positioned at the projectile retaining element adjacent the improvised projectile checking lock gauge thereof.

9. The toy launch apparatus of claim 8, wherein:
the improvised projectile checking lock gauge allows the verified projectile with the corresponding step present at the improvised projectile checking lock gauge.

10. The toy launch apparatus of claim 7, wherein:
the verified projectile comprises a plurality of fins for positioning adjacent the improvised projectile checking lock gauge.

11. The toy launch apparatus of claim 7, wherein:
the verified projectile comprises a rearward nub for positioning adjacent the improvised projectile checking lock gauge.

12. A toy launch apparatus with multiple improvised projectile checking and locking features, comprising:
a projectile retaining element having a front side and a backside on the toy launch apparatus for receiving projectiles therein at the backside of the projectile retaining element;
a projectile propelling mechanism forward the projectile retaining element for propelling the received projectiles from the front side of the projectile retaining element;
an improvised projectile checking lock gauge supported with the toy launch apparatus rearward the projectile retaining element where said gauge is disposed to translate alongside the projectiles received at the backside of the projectile retaining element for checking the outer diameter of received projectiles;
a follower housing configured to reciprocate adjacent and rearward the backside of the projectile retaining element and towards the front side thereof;
a linkage in the toy launch apparatus for moving the follower housing;
a pusher coupled to the follower housing for advancing projectiles received at the backside of the projectile retaining element; and
a catch at said gauge preventing advancing of the projectile forward in the projectile retaining element.

13. The toy launch apparatus of claim 12, comprising:
a pathway at the pusher cooperatively positioned in relation to the catch at said gauge where said gauge having translated alongside the projectile to confirm the outer diameter of a verified projectile allows the pathway of the pusher to pass the catch of said gauge and advance the projectile forward in the projectile retaining element; and
at least one latch at the pusher positioned to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

14. The toy launch apparatus of claim 13, comprising:
a cam surface to translate said gauge with said follower housing configured to reciprocate with the linkage moving the follower housing where the catch at said gauge locks the pusher in relation to alignment having the pathway at the pusher cooperatively positioned in relation to the catch at said gauge with said gauge having translated.

15. The toy launch apparatus of claim 12, comprising:
a cam surface to translate said gauge with said follower housing configured to reciprocate with the linkage moving the follower housing;
a pathway at the pusher cooperatively positioned in relation to the catch at said gauge where said gauge having translated alongside the projectile to confirm the outer diameter of a verified projectile allows the pathway of the pusher to pass the catch of said gauge and advance the projectile forward in the projectile retaining element; and
at least one latch at the pusher positioned to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

16. A method for making a toy launch apparatus with multiple improvised projectile checking and locking features, comprising the steps of:
forming a projectile retaining element having a front side and a backside on the toy launch apparatus for receiving projectiles therein at the backside of the projectile retaining element;
positioning a projectile propelling mechanism forward the projectile retaining element for propelling the received projectiles from the front side of the projectile retaining element;
supporting an improvised projectile checking lock gauge with the toy launch apparatus rearward the projectile retaining element where said gauge is supported to translate alongside the projectiles received at the backside of the projectile retaining element for checking the outer diameter of received projectiles; and
providing a catch at said gauge preventing advancing of the projectile forward in the projectile retaining element.

17. The method of claim 16, comprising the steps of:
configuring a follower housing to reciprocate adjacent and rearward the backside of the projectile retaining element and towards the front side thereof; and
coupling a pusher to the follower housing for advancing projectiles received at the backside of the projectile retaining element.

18. The method of claim 17, comprising the steps of:
positioning a pathway at the pusher cooperatively in relation to the catch at said gauge where said gauge having translated alongside the projectile to confirm the outer diameter of a verified projectile allows the pathway of the pusher to pass the catch of said gauge and advance the projectile forward in the projectile retaining element; and
positioning at least one latch at the pusher to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

19. The method of claim 17, comprising the steps of:
providing a linkage in the toy launch apparatus for moving the follower housing;
providing a cam surface to translate said gauge with said follower housing configured to reciprocate with the linkage moving the follower housing.

20. The method of claim 19, comprising the steps of:

positioning a pathway at the pusher cooperatively in relation to the catch at said gauge where said gauge having translated alongside the projectile to confirm the outer diameter of a verified projectile allows the pathway of the pusher to pass the catch of said gauge and advance the projectile forward in the projectile retaining element; and positioning at least one latch at the pusher to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

* * * * *